US009133682B2

(12) United States Patent
Tahoun et al.

(10) Patent No.: US 9,133,682 B2
(45) Date of Patent: Sep. 15, 2015

(54) APPARATUS AND METHOD TO REMOTELY CONTROL FLUID FLOW IN TUBULAR STRINGS AND WELLBORE ANNULUS

(71) Applicants: MIT Innovation Sdn Bhd, Kuala Lumpur (MY); Petroliam Nasional Berhad (PETRONAS), Kuala Lumpur (MY)

(72) Inventors: Ahmed Moustafa Tahoun, Agawam, MA (US); Raed Ismail Kafafy, Kuala Lumpur (MY); Karam J. Jawamir, Kuala Lumpur (MY); Mohammed Abdulmalek Aldheeb, Kuala Lumpur (MY); Abdul Mushawwir Khalil, Kuala Lumpur (MY)

(73) Assignees: MIT Innovation Sdn Bhd (MY); Petroliam Nasional Berhad (PETRONAS) (MY)

( * ) Notice: Subject to any disclaimer, the term of this patent is extended or adjusted under 35 U.S.C. 154(b) by 0 days.

(21) Appl. No.: 13/861,255

(22) Filed: Apr. 11, 2013

(65) Prior Publication Data

US 2013/0269951 A1 Oct. 17, 2013

Related U.S. Application Data

(63) Continuation-in-part of application No. 13/846,946, filed on Mar. 18, 2013.

(60) Provisional application No. 61/622,572, filed on Apr. 11, 2012, provisional application No. 61/710,887, filed on Oct. 8, 2012, provisional application No. 61/710,823, filed on Oct. 8, 2012.

(51) Int. Cl.

| | |
|---|---|
| ***E21B 34/06*** | (2006.01) |
| ***E21B 21/10*** | (2006.01) |

(Continued)

(52) U.S. Cl.

CPC ..... *E21B 34/06* (2013.01); *E21B 21/103* (2013.01); *E21B 23/006* (2013.01); *E21B 34/066* (2013.01); *E21B 34/102* (2013.01); *E21B 41/0085* (2013.01); *E21B 2034/002* (2013.01)

(58) Field of Classification Search

CPC .... E21B 2034/002; E21B 21/103; F16K 5/06
USPC ..... 166/334.2, 320, 330, 332.2
See application file for complete search history.

(56) References Cited

U.S. PATENT DOCUMENTS

| | | | |
|---|---|---|---|
| 163,161 | A | 5/1875 | Dawson |
| 2,128,352 | A | 10/1936 | Creighton |

(Continued)

FOREIGN PATENT DOCUMENTS

| | | | |
|---|---|---|---|
| GB | 2309470 | A | 7/1997 |
| WO | 9947789 | A1 | 9/1999 |

(Continued)

OTHER PUBLICATIONS

International search report and the written opinion of the international searching authority, or the declaration, Form PCT/ISA/220 and PCT/ISA/237, Jun. 17, 2013, 10 pages.

(Continued)

*Primary Examiner* — Shane Bomar
*Assistant Examiner* — Kipp Wallace
(74) *Attorney, Agent, or Firm* — Charles Knobloch; Arnold, Knobloch & Saunders, L.L.P.

(57) ABSTRACT

A method and apparatus is disclosed for remotely and selectively controlling fluid flow through tubular string disposed within a wellbore and further control fluid flow between the tubular string inner flow passage and the annular flow passage. The present invention further discloses a method of selectively and remotely receiving and interpreting a form of command or information at a desired apparatus within the wellbore caused by the operator on earth surface.

20 Claims, 25 Drawing Sheets

(51) Int. Cl.

| | |
|---|---|
| ***E21B 23/00*** | (2006.01) |
| ***E21B 34/10*** | (2006.01) |
| ***E21B 41/00*** | (2006.01) |
| *E21B 34/00* | (2006.01) |

(56) References Cited

U.S. PATENT DOCUMENTS

| | | | | |
|---|---|---|---|---|
| 3,552,412 | A | | 1/1971 | Hagar et al. |
| 3,665,955 | A | * | 5/1972 | Conner, Sr. ..... 137/495 |
| 3,667,557 | A | | 6/1972 | Todd et al. |
| 4,058,165 | A | | 11/1977 | Holder et al. |
| 4,072,166 | A | | 2/1978 | Tiraspolsky |
| 4,289,165 | A | * | 9/1981 | Fredd ..... 137/625.32 |
| 4,373,582 | A | | 2/1983 | Bednar et al. |
| 4,445,571 | A | | 5/1984 | Hushbeck |
| 4,452,313 | A | | 6/1984 | McMahan |
| 4,574,894 | A | | 3/1986 | Jadwin |
| 4,576,233 | A | | 3/1986 | George |
| 4,603,742 | A | | 8/1986 | Wong et al. |
| 4,655,078 | A | * | 4/1987 | Johnson ..... 73/168 |
| 4,655,289 | A | | 4/1987 | Schoeffler |
| 4,889,199 | A | | 12/1989 | Lee |
| 5,048,611 | A | | 9/1991 | Cochran |
| 5,318,138 | A | | 6/1994 | Dewey et al. |
| 5,437,308 | A | | 8/1995 | Morin et al. |
| 5,499,687 | A | | 3/1996 | Lee |
| 5,794,699 | A | * | 8/1998 | Hammett et al. ..... 166/332.3 |
| 5,894,890 | A | * | 4/1999 | Garcia-Soule et al. ..... 166/356 |
| 5,944,055 | A | * | 8/1999 | Dicky ..... 137/625.47 |
| 6,148,664 | A | | 11/2000 | Baird |
| 6,182,764 | B1 | | 2/2001 | Vaynshteyn |
| 6,289,999 | B1 | | 9/2001 | Dewey et al. |
| 6,328,109 | B1 | | 12/2001 | Pringle et al. |
| 6,923,255 | B2 | | 8/2005 | Lee |
| 7,334,650 | B2 | | 2/2008 | Giroux et al. |
| 7,347,288 | B2 | | 3/2008 | Lee |
| 7,347,289 | B2 | | 3/2008 | Lee |
| 7,520,336 | B2 | | 4/2009 | Mondelli et al. |
| 7,533,728 | B2 | | 5/2009 | Winslow et al. |
| 7,905,292 | B2 | | 3/2011 | Beall et al. |
| 8,327,954 | B2 | | 12/2012 | Desai |
| 2004/0035586 | A1 | * | 2/2004 | Gudmestad et al. ..... 166/373 |
| 2005/0087367 | A1 | | 4/2005 | Hutchinson |
| 2005/0269134 | A1 | * | 12/2005 | Strazhgorodskiy ..... 175/57 |
| 2008/0164062 | A1 | | 7/2008 | Brackin et al. |
| 2008/0315144 | A1 | * | 12/2008 | Thomas ..... 251/315.1 |
| 2009/0218100 | A1 | | 9/2009 | Williams |
| 2011/0048723 | A1 | | 3/2011 | Edwards |
| 2011/0088906 | A1 | | 4/2011 | Myerley |
| 2011/0088914 | A1 | | 4/2011 | Howell et al. |
| 2011/0155393 | A1 | | 6/2011 | Loretz |
| 2012/0255741 | A1 | | 10/2012 | Stewart |
| 2013/0048290 | A1 | * | 2/2013 | Howell et al. ..... 166/305.1 |

FOREIGN PATENT DOCUMENTS

| | | | |
|---|---|---|---|
| WO | 2007021274 | A1 | 2/2007 |
| WO | 2011119668 | A1 | 9/2011 |
| WO | 2013154420 | A2 | 10/2013 |

OTHER PUBLICATIONS

Notification of transmittal of international search report and the written opinion of the international searching authority, or the declaration issued Feb. 28, 2014, based on PCT/MY13/000078, filed Apr. 10, 2013, 14 pages.

Notification of transmittal of international preliminary report on patentability based on PCT/US13/36238, Feb. 18, 2014, 8 pages.

* cited by examiner

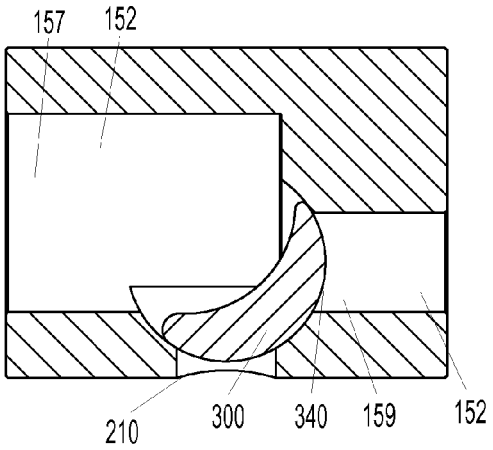
FIG. 7A1
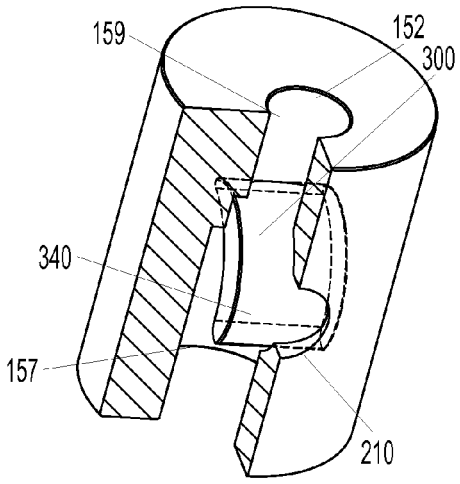
FIG. 7A2
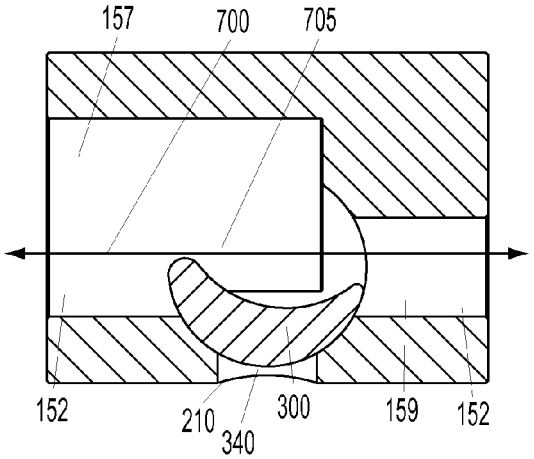
FIG. 7B1
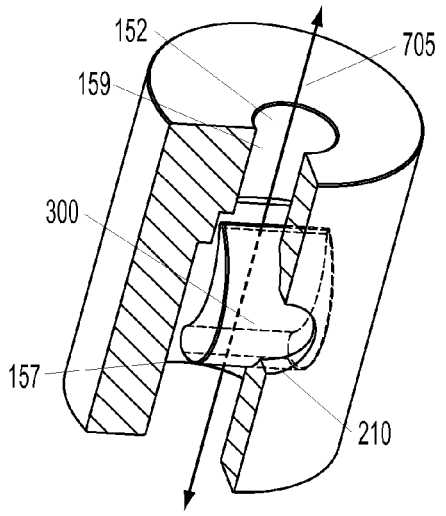
FIG. 7B2

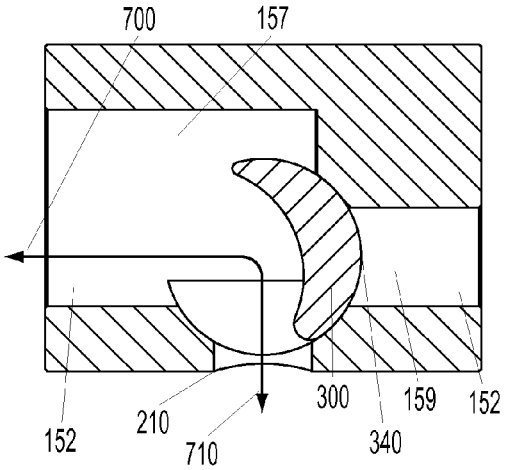
FIG. 7C1
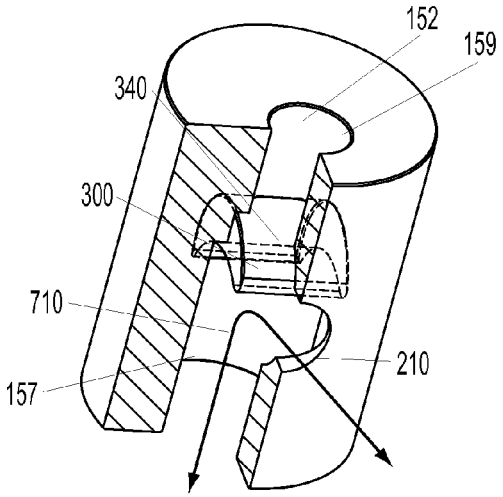
FIG. 7C2
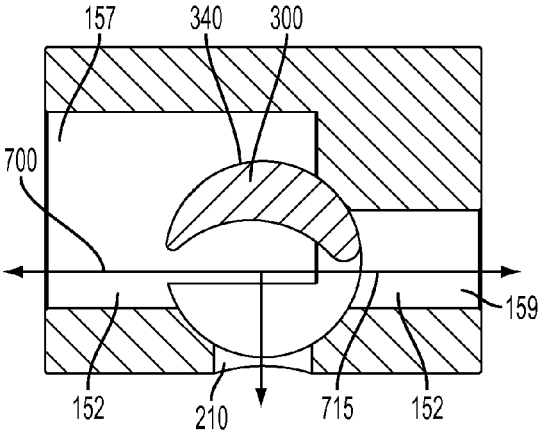
FIG. 7D1
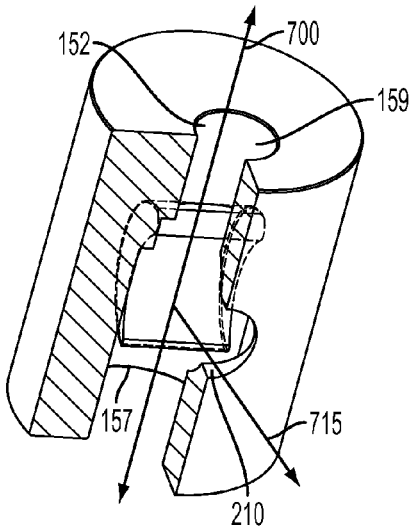
FIG. 7D2
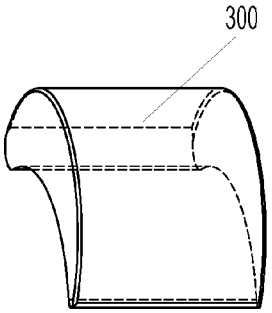
FIG. 7E

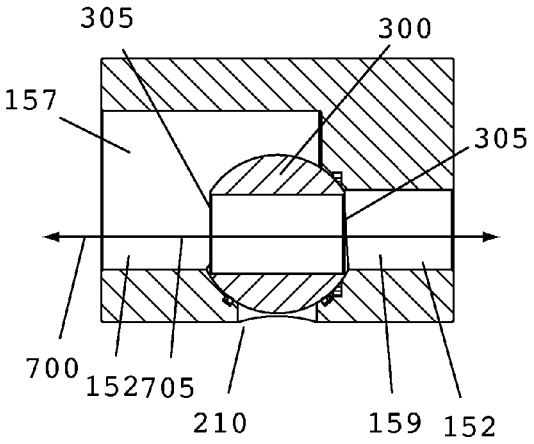
FIG. 8A1
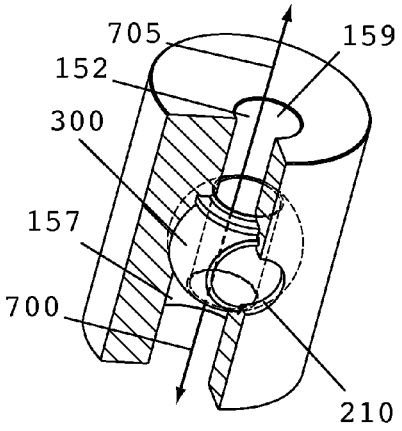
FIG. 8A2
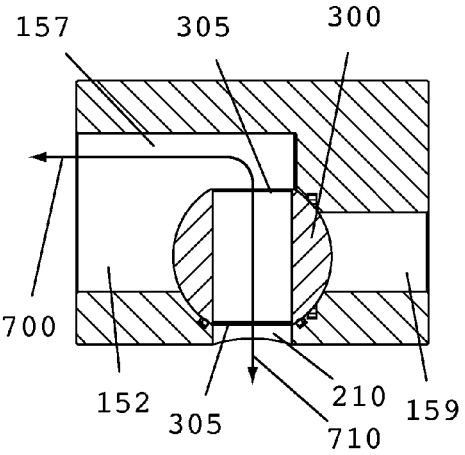
FIG. 8B1
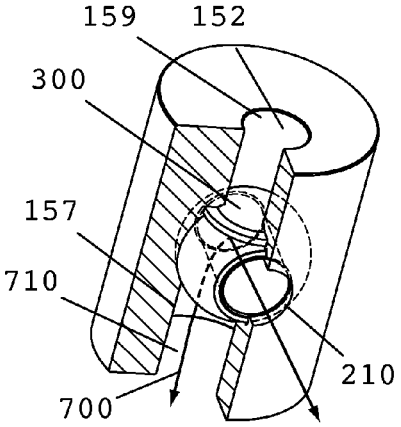
FIG. 8B2
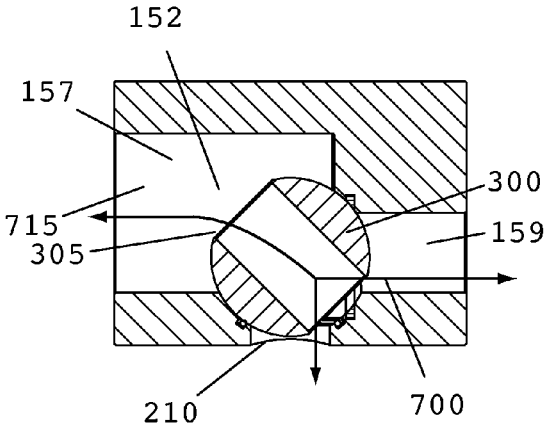
FIG. 8C1
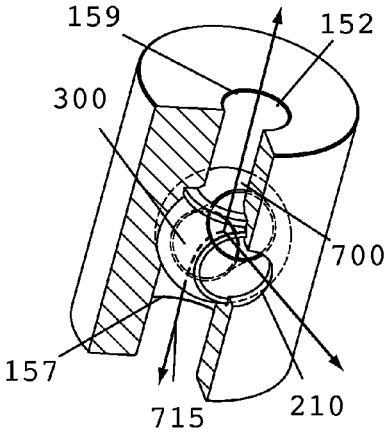
FIG. 8C2

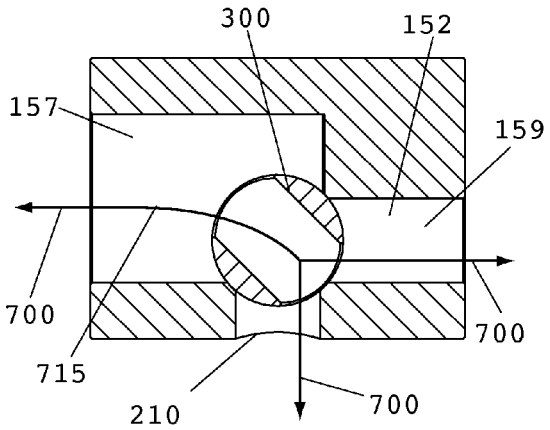
FIG. 9C1
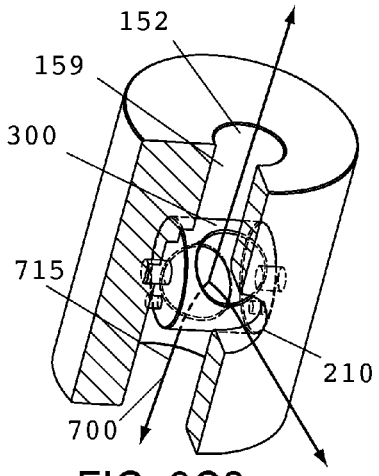
FIG. 9C2
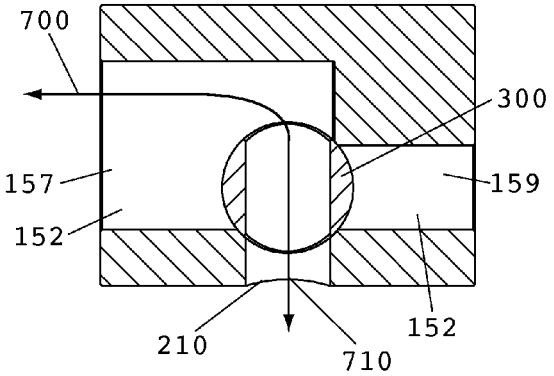
FIG. 9B1
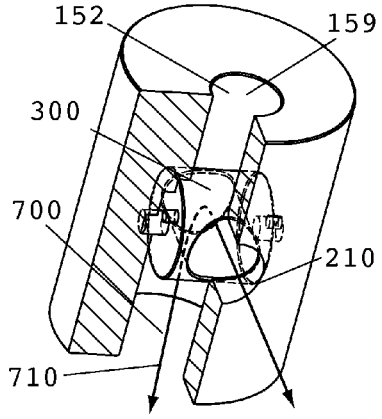
FIG. 9B2
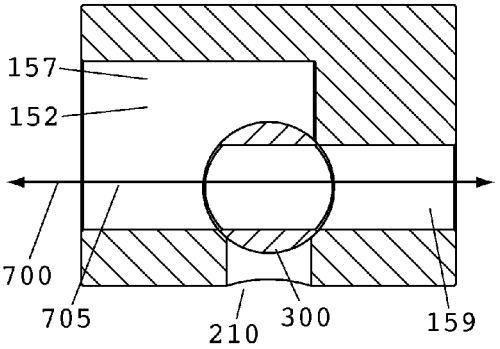
FIG. 9A1
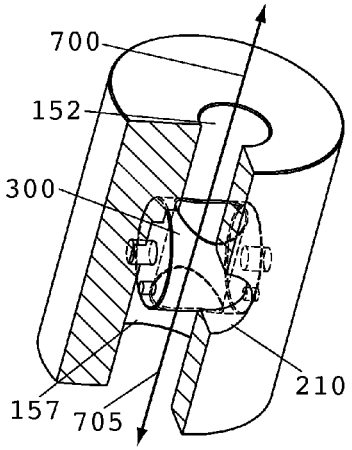
FIG. 9A2

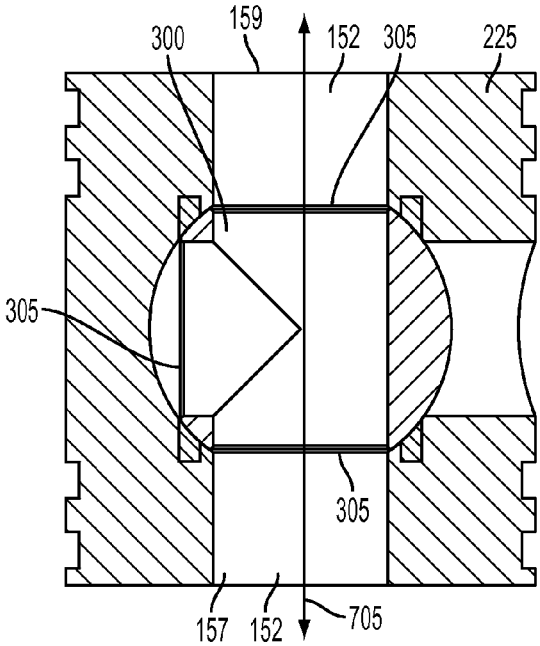
FIG. 10A1
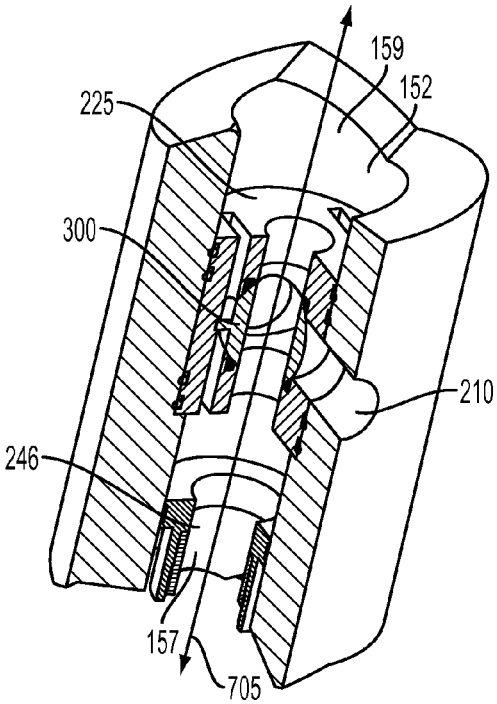
FIG. 10A2
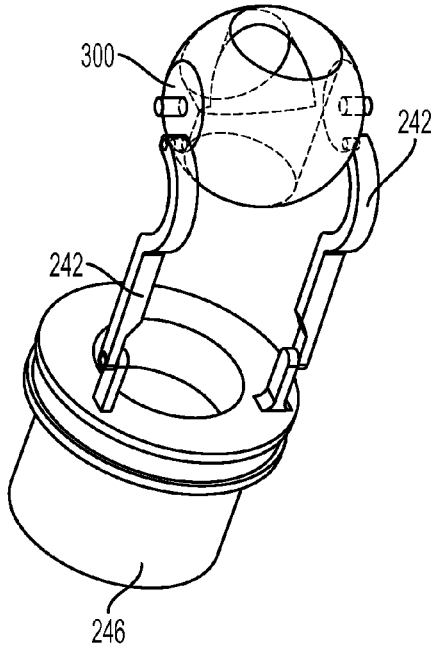
FIG. 10A3

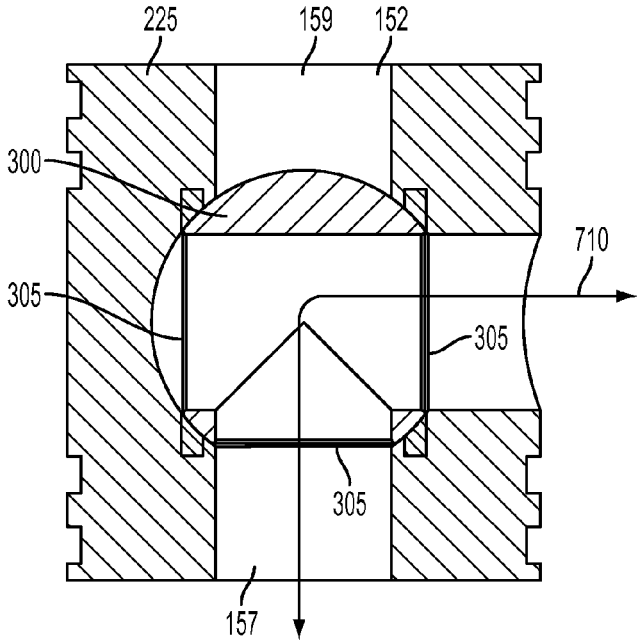
FIG. 10B1
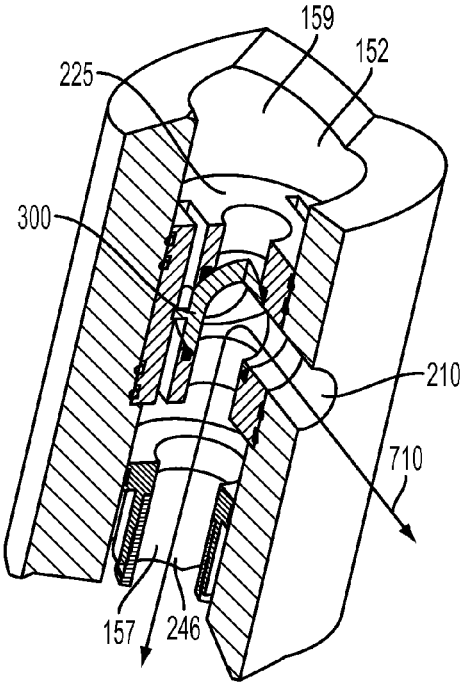
FIG. 10B2
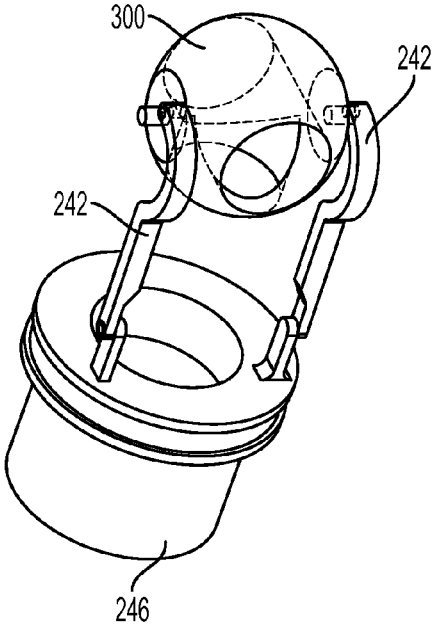
FIG. 10B3

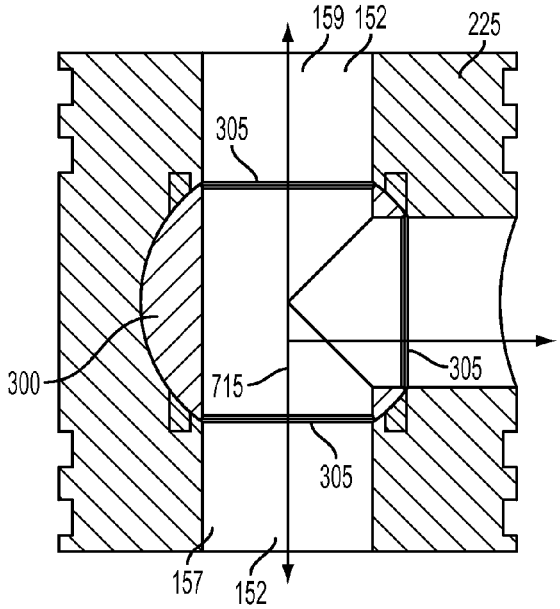
FIG. 10C1
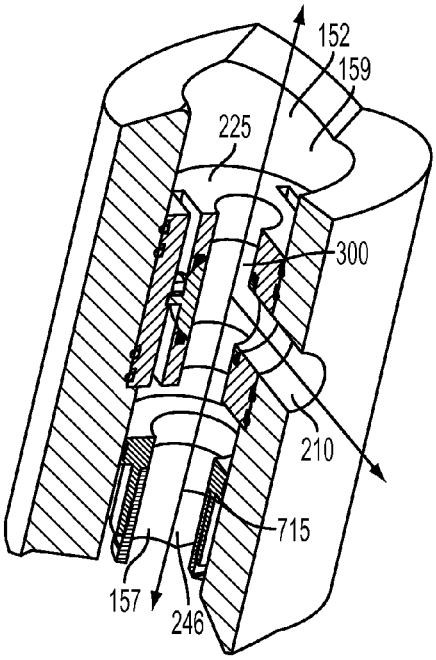
FIG. 10C2
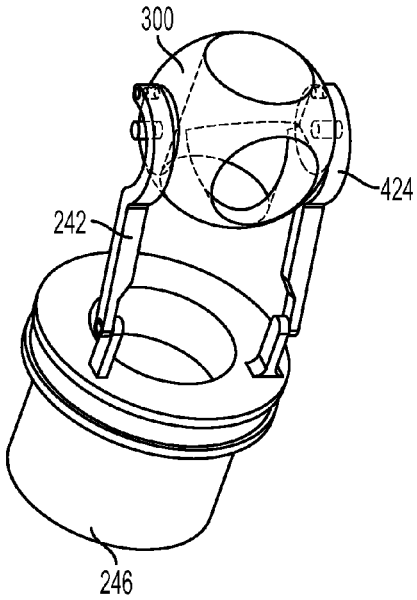
FIG. 10C3

APPARATUS AND METHOD TO REMOTELY CONTROL FLUID FLOW IN TUBULAR STRINGS AND WELLBORE ANNULUS

CROSS REFERENCE TO RELATED APPLICATIONS

This application claims the benefit of U.S. Provisional Application No. 61/710,887, filed Oct. 8, 2012.

This application claims the benefit of U.S. Provisional Application No. 61/622,572, filed Apr. 11, 2012.

This application claims the benefit of U.S. Provisional Application No. 61/710,823, filed Oct. 8, 2012.

BACKGROUND OF INVENTION

1. Technical Field

This invention is related to tools and methods that are used, for example, in oil and gas drilling and completion. The present invention is related, for example, to a device or apparatus for controlling fluid flow within a tubular string. In a particular example, the device or apparatus is used in the control of fluid flow between a tubular string inner flow passage and its annular flow passage in the wellbore by selectively and remotely sending a command to the apparatus disposed within wellbore.

2. Discussion of Background

U.S. Patent Application Publication US20120255741A1 published on Oct. 11, 2012 for ANNULAR CIRCULATION VALVE AND METHODS OF USING THE SAME, by A. Stewart, and is herein incorporated by reference.

U.S. Patent Application Publication US20110088914A1 published on Apr. 21, 2011 for METHOD OF ACTIVATING A DOWNHOLE TOOL ASSEMBLY, by M. Howell, et al. and is herein incorporated by reference.

U.S. Patent Application Publication US20110048723A1 published on Mar. 3, 2011 for MULTI-ACTING CIRCULATING VALVE by J. Edwards, and is herein incorporated by reference.

U.S. Patent Application Publication US20110088906A1 published on Apr. 21, 2011 for PRESSURE EQUALIZING A BALL VALVE THROUGH AN UPPER SEAL BYPASS, by T. Myerley, and is herein incorporated by reference.

U.S. Pat. No. 8,327,954B2 issued on Dec. 11, 2012 for OPTIMIZED REAMING SYSTEM BASED UPON WEIGHT ON TOOL, by P. Desai, and is herein incorporated by reference.

U.S. Pat. No. 7,905,292B2 issued on Mar. 15, 2011 for PRESSURE EQUALIZATION DEVICE FOR DOWNHOLE TOOLS, by C. Beall, et al. and is herein incorporated by reference.

U.S. Pat. No. 7,533,728B2 issued on May 19, 2009 for BALL OPERATED BACK PRESSURE VALVE, by D. Winslow, et al. and is herein incorporated by reference.

U.S. Pat. No. 7,520,336B2, issued on Apr. 21, 2009 for MULTIPLE DART DROP CIRCULATING TOOL, by M. Modelli, and is herein incorporated by reference.

U.S. Pat. No. 7,347,289B2 issued on Mar. 25, 2008 for DART-OPERATED BIG BORE BY-PASS VALVE, by P. Lee, and is herein incorporated by reference.

U.S. Pat. No. 7,347,288B2 issued on Mar. 25, 2008 for BALL OPERATED BY-PASS TOOL FOR USE IN DRILLSTRING, by P. Lee, and is herein incorporated by reference.

U.S. Pat. No. 7,334,650B2 issued on Feb. 26, 2008 for APPARATUS AND METHODS FOR DRILLING A WELLBORE USING CASING, by R. Giroux, et al. and is herein incorporated by reference.

U.S. Pat. No. 6,923,255B2 issued on Aug. 2, 2005 for ACTIVATING BALL ASSEMBLY FOR USE WITH A BYPASS TOOL IN A DRILL TRING, by P. Lee, and is herein incorporated by reference.

U.S. Pat. No. 6,328,109B1 issued on Dec. 11, 2001 for DOWNHOLE VALVE, by R. Pringle, et al. and is herein incorporated by reference.

U.S. Pat. No. 6,289,999B1 issued on Sep. 18, 2001 for FLUID FLOW CONTROL DEVICES AND METHODS FOR SELECTIVE ACTUATION OF VALVES AND HYDRAULIC DRILLING TOOLS, by C. Dewey, et al. and is herein incorporated by reference.

U.S. Pat. No. 6,148,664A issued on Nov. 21, 2000 for METHOD AND APPARATUS FOR SHUTTING IN A WELL WHILE LEAVING DRILL STEM IN THE BOREHOLE, by J. Baird, and is herein incorporated by reference.

U.S. Pat. No. 5,499,687A issued on Mar. 19, 1996 for DOWNHOLE VALVE FOR OIL/GAS WELL, by P. Lee, and is herein incorporated by reference.

U.S. Pat. No. 5,437,308A issued on Aug. 1, 1995 for DEVICE FOR REMOTELY ACTUATING EQUIPMENT COMPRISING A BEAN-NEEDLE SYSTEM, by P. Morin, et al. and is herein incorporated by reference.

U.S. Pat. No. 5,318,138 issued on Jun. 7, 1994 for ADJUSTABLE STABILIZER, by C. Dewey, et al. and is herein incorporated by reference.

U.S. Pat. No. 5,048,611 issued on Sep. 17, 1991 for PRESSURE OPERATED CIRCULATING VALVE, by C. Cochran, and is herein incorporated by reference.

U.S. Pat. No. 4,889,199 issued on Dec. 26, 1999 for DOWNHOLE VALVE FOR USE WHEN DRILLING AN OIL AND GAS WELL, by P. Lee, and is herein incorporated by reference.

U.S. Pat. No. 4,655,289 issued on Apr. 7, 1987 for REMOTE CONTROL SELECTOR VALVE, by W. Schoeffler, and is herein incorporated by reference.

U.S. Pat. No. 4,574,894 issued on Mar. 11, 1986 for BALL ACTUATED DUMP VALVE, by R. Jadwin, and is herein incorporated by reference.

U.S. Pat. No. 4,576,233 issued on Mar. 18, 1986 for DIFFERENTIAL PRESSURE ACTUATED VENT ASSEMBLY, by F. George, and is herein incorporated by reference.

U.S. Pat. No. 4,452,313 issued on Jun. 5, 1984 for CIRCULATION VALVE, by M. McMahan, and is herein incorporated by reference.

U.S. Pat. No. 4,445,571 issued on May 1, 1984 for CIRCULATION VALVE, by D. Hushbeck, and is herein incorporated by reference.

U.S. Pat. No. 4,072,166 issued on Feb. 7, 1978 for VALVE APPARATUS FOR DEEP DRILLING, by W. Tiraspolsky, et al. and is herein incorporated by reference.

U.S. Pat. No. 3,552,412 issued on Jan. 5, 1971 for DRILL STRING DUMP VALVE, by D. Hagar, et al. and is herein incorporated by reference.

U.S. Pat. No. 4,058,165 issued on Aug. 30, 1938 for TESTING CIRCULATING VALVE, by J. Holden, and is herein incorporated by reference.

U.S. Pat. No. 2,128,352, issued on Oct. 20, 1936 for METHOD AND APPARATUS FOR RELEASING FLUID FROM DRILL PIPE, by T. Creighton, and is herein incorporated by reference.

U.S. Pat. No. 163,161 issued on May 11, 1875 for IMPROVEMENT IN MAINSPRINGS FOR WATCHES, by JOHN A. DAWSON, and is herein incorporated by reference.

One example of the current invention is to introduce a method and apparatus for selectively and remotely controlling fluid flow through a tubular string and its surrounding wellbore annulus and, thus, changing the fluid flow profile within wellbore. In one example, a fraction or all of the fluid is diverted from within the inner fluid flow passage of the tubular string and the apparatus to the wellbore annulus. In one example, the current invention makes it possible to control the fluid flow profile in the wellbore and tubular string and, accordingly, significantly reduce risks and operating cost associated with cutting beds. Risks associated with fluid-losses are caused by various reasons, some of which were explained by way of examples: risks associated with accumulation of suspended cuttings, among other operating risks, where change of fluid flow profile within the wellbore is desired. In another example of the current invention, a method is introduced for remotely operating a downhole apparatus selectively into a desired state without limiting other operations, such as flow rate or flow pressure, during periods when it is not desired to change fluid flow pattern.

U.S. Pat. No. 4,889,199 to Lee discloses a plastic, i.e., deformable ball used to block a flow opening in the sleeve for positioning the sleeve and aligning flow ports. This form of flow control apparatus is operated using what is called drop ball. A ball is inserted into the string at the surface and pumped down the inner flow passage of the tubular string to engage the sleeve profile. Such drop ball-operated apparatus often introduces limitations to the drilling practices, causing increase in operating cost. For example, the drop ball introduces restrictions within the inner flow passage and imposes limitations on running services using wireline to access, for example, to run free point services or interact with logging while drilling equipment located beneath the drop ball operated apparatus.

Another form of flow control apparatus, sometimes called bypass tool or called circulation apparatus, defines ports in the apparatus body which are initially closed by an axially movable sleeve.

Other downhole remotely-operated apparatus, such as those in sited references, induce limitation in the operating practice since fluid flow properties such as flow rate or pressure must to be kept within certain levels to maintain the apparatus in the corresponding state. This limitation causes the drilling operation efficiency to suffer as it may be desirable to operate the drilling fluid, for example, with a different flow profile, such as at a different flow rate or pressure that my undesirably cause the apparatus to change mode.

What is needed is a way to selectively turn on or off the flow control device, locking it in a particular desired fluid flow profile (or "state") when in an "off" or disabled mode along with a way to selectively turn "on" the flow control device (into an "enabled" mode) and thereby be enabled to change to another desired fluid flow profile (change to another "state"). To further satisfy this need, what is needed is a way to communicate the desired mode and desired state to the flow control device using deliberate changes to the environment surrounding the flow control device, such as altering the pressure of the fluid in the tubular or wellbore in a predetermined sequence, or using a combination of sensors to discern the communicated command. What is further needed is a way to power the actuation of the flow control device between the various fluid flow states and power to set the enabled or disabled mode.

SUMMARY OF SOME EXAMPLES OF THE INVENTION

In one example, disclosed is an apparatus for remotely controlling fluid flow in a wellbore based on changing the environment in the wellbore, the apparatus disposed on a tubular string in the wellbore, the apparatus including: a body, an inner passage through the body, an orifice to the inner passage disposed on a lateral side of the body, a valve having a movable element, the valve disposed in fluid communication with the inner passage and the orifice, a means for actuating the valve element, a means for powering the means for actuating the valve element, a means for disabling movement of the valve element, a means for detecting at least one change in the environment in the wellbore, a means for decoding the at least one change in the environment, wherein the means for disabling movement of the valve element is responsive to the means for decoding, and wherein the means for actuating the valve element is responsive to the means for decoding.

In one example, the moveable element is rotatable to a plurality of predetermined positions.

In one example, the plurality of predetermined positions comprises at least two predetermined positions selected from the set of predetermined positions including: restricted fluid flow through the inner flow passage and restricted flow between the inner flow passage and a wellbore annulus through the orifice; fluid flow through the inner flow passage and restricted fluid flow between the inner flow passage and a wellbore annulus through the orifice; fluid flow communication between a first end of the body and a wellbore annulus and restricted flow between a second end of the body and the wellbore annulus; and fluid flow communication between the first end of the body and a wellbore annulus and fluid flow communication between the second end of the body and the wellbore annulus.

In one example, the rotatable element comprises at least one surface of spherical shape and at least two ports and one cavity.

In one example, the detecting means comprises a sensor. In one example, the sensor is positioned and arranged in the wellbore environment and configured to sense at least one physical property of the environment.

In one example, the apparatus comprises: at least one means for detecting a plurality of intended changes in at least one physical property of the environment resulting in a detectable signal within the apparatus for processing the signal.

In one example, the means for powering comprises an electric generator.

In one example, the electric generator is an electric generator positioned and arranged to receive hydraulic energy from fluid in the tubular string and is configured to provide electrical energy to the means for actuating.

In one example, the electric generator is an electric generator positioned and arranged to receive hydraulic energy from a fluid pressure difference between the inner fluid passage and the annular fluid passage.

In one example, the means for powering comprises a means for transforming hydraulic energy from fluid in the wellbore.

In one example, the means for powering comprises an energized resilient element.

In one example, the means for actuating comprises an electric motor.

In one set of examples, disclosed is an apparatus for remotely controlling fluid flow in a tubular string 110 and a wellbore annulus 156, the apparatus including: a body 200 defining the boundaries between an inner flow passage 152 through the apparatus and an annular flow passage 154 within the wellbore annulus 156, the body including: a first end disposed at one end of the body, a second end disposed at another end of the body, and at least one lateral hole 210 disposed in a side of the body for connecting the inner flow passage 152 and the annular flow passage 154; a controllable valve 220 disposed in the inner flow passage 152, the controllable valve 220 comprising at least one moveable element, and where the element is movable to a plurality of predetermined positions, positioned and arranged to alter fluid flow between the first end, the second end, and the at least one lateral hole, and where a predetermined position of movable element determines a desired altered fluid flow state of controllable valve 220; a means for actuating the moveable element into at least one of the plurality of predetermined positions; a means for powering the means for actuating the moveable element; a means for disabling movement of the moveable element; a means for detecting at least one change in at least one physical property in an environmental condition within the wellbore; a means for decoding at least one instruction from the at least one detected change in the environmental condition; and where the means for disabling movement of the valve element is responsive to an instruction of the at least one decoded instruction; and where the means for actuating the valve element into the at least one of the plurality of predetermined positions is responsive to an instruction of the at least one decoded instruction.

In one example, the moveable element is rotatable to a plurality of predetermined positions.

In one example, the plurality of predetermined positions comprise at least two predetermined positions selected from the set of predetermined positions including: restricted fluid flow through the inner flow passage and restricted flow between the inner flow passage and the wellbore annulus through the orifice, fluid flow through the inner flow passage and restricted fluid flow between the inner flow passage and the wellbore annulus through the orifice; fluid flow communication between the first end of the body and the annular flow passage and restricted flow between the second end of the body and the annular flow passage; and fluid flow communication between the first end of the body and the annular flow passage and fluid flow communication between the second end of the body and the annular flow passage.

In one example, the moveable element is suitably positioned to cause the valve into a at least one state such that the flow pattern will be in one of the following patterns: (a) no flow pattern wherein the flow passage between the upstream and the downstream is restricted and the flow passage between the inner flow passage and the annular flow passage is also restricted; (b) through flow pattern wherein the passage between the upstream and the downstream of the inner flow passage is not restricted whereas the passage between the inner flow passage and the annular flow passages is restricted; (c) diverted flow pattern wherein the flow passage between the upstream and the said annular flow passage is not restricted whereas the flow passage to the downstream is restricted; and (d) full flow pattern wherein the flow passage between the upstream and the downstream of the inner flow passage is not restricted and the flow passage between the said inner flow passage and the annular flow passages is not restricted.

In one example, the means for actuating the moveable element into at least one of the plurality of predetermined positions includes an actuation mandrel 246 connected to actuation linkage 242 attached to push-pull point 308 causing the movable element to rotate and change its position. In one example, the means for actuating the moveable element into at least one of the plurality of predetermined positions includes a pinion 420 connected to the movable element and at least one rack 410 connected to an actuation mandrel 246, the rack 410 and the pinion 420 engaged to move rack 410 in ascertain direction as the pinion 420 rotates around a pivot 307. In one example, the means for actuating the moveable element into at least one of the plurality of predetermined positions includes an electric motor mechanically connected to the moveable element.

In one example, the means for powering the means for actuating the moveable element includes an actuation mandrel 246 attached to a resilient element. In one example, the resilient element is a spring. In one example, the means for powering includes an energized spring connected to a pinion through a worm gear. In one example, the means for powering the means for actuating the moveable element includes an inertia element 510 disposed within the actuation mandrel 246 having a mass capable of storing kinetic energy. In one example, the means for powering includes an electrical energy source. In one example, the electrical energy source is a battery. In one example, the electrical energy source is a wireline from the surface. In one example, the electrical energy source is a fluid powered electric generator. In one example, the means for powering includes a turbine transforming hydraulic fluid flowing through the wellbore. In one example, the means for powering is disposed in the tubular string. In one example, the means for powering is disposed in a bottom hole assembly.

In one example, the means for disabling movement of the moveable element includes a locking means. In one example, the means for disabling includes a lock 277 element engageable with a locking groove 278 connected to an actuation mandrel 246. In one example, the means for disabling includes a lock driver 720 driving a lock 277. In one example, lock driver 720 is a motor. In one example, lock driver 720 is a solenoid. In one example, the means for disabling includes means for disconnecting electric energy from an electric motor or solenoid. In one example, the means for disabling includes a controller disconnecting electric energy from an electric motor or solenoid.

In one example, the means for detecting at least one change in at least one physical property in an environmental condition within the wellbore includes a sensor. In one example, the means for detecting includes a pressure sensor 272 configured to sense pressure variation within the wellbore. In one example, the means for detecting includes a flow sensor 272 configure to sense variation of fluid flow rate within the wellbore. In one example, the means for detecting includes an electrode to sense a change in voltage or current with respect to the tubular string 110. In one example, the means for detecting includes an electrode to sense a change in voltage or current from an induced electric signal into the formation. In one example, the means for detecting includes an accelerometer affected by change of tubular string 110 movement. In examples, the accelerometer is configured to sense movement in one or more directions. In one example, the means for detecting includes a sensor configured to sense magnetic field changes. In one example, the means for detecting includes a chemical sensor.

In one example, the means for decoding at least one instruction from the at least one detected change in the environmental condition includes a barrel cam track and cam follower. In one example, the barrel cam track is disposed on a barrel cam, the barrel cam connected to an actuation mandrel. In one example, the means for decoding at least one instruction from the at least one detected change in the environmental condition includes a controller configured to compare a detected signal pattern to a predetermined command pattern. In one example, the controller is an electronic controller. In one example, the controller is an electronic computational device.

In one set of examples, disclosed is an apparatus for remotely controlling fluid flow in tubular strings and wellbore annulus, including: (a) a body defining the boundaries between an inner flow passage through the said apparatus and an annular flow passage within the wellbore annulus and having two suitable end connections and at least one lateral hole suitable for connecting the inner flow passage and the annular flow passage; (b) a controllable valve operable in plurality of desired states altering fluid flow pattern within a wellbore, wherein the valve is having at least one rotatable element having plurality of surfaces, where the rotatable element is rotatable to a plurality of desired positions wherein the valve further divides the inner flow passage into upstream section and downstream, wherein the upstream section is the portion of the inner flow passage from the valve and through one end connection of the body and the downstream section is the portion of the inner flow passage from the valve and through the other end connection of the body; (c) an activator disposed within the body capable of selectively changing the apparatus into either one of two modes: a disabled mode, wherein the said valve is not operable, and an enabled mode, wherein the said valve is operable to a desired state, comprising a means responsive to an intended change in an environment; and (d) an actuator capable of changing the position of the said rotatable element to cause the valve into a desired state comprising a means for transforming a suitably available energy source into a mechanical movement.

In one example, the rotatable element is suitably positioned to cause the valve into a at least one state such that the flow pattern will be in one of the following patterns: (a) no flow pattern wherein the flow passage between the upstream and the downstream is restricted and the flow passage between the inner flow passage and the annular flow passage is also restricted; (b) through flow pattern wherein the passage between the upstream and the downstream of the inner flow passage is not restricted whereas the passage between the inner flow passage and the annular flow passages is restricted; (c) diverted flow pattern wherein the flow passage between the upstream and the said annular flow passage is not restricted whereas the flow passage to the downstream is restricted; and (d) full flow pattern wherein the flow passage between the upstream and the downstream of the inner flow passage is not restricted and the flow passage between the said inner flow passage and the annular flow passages is not restricted.

In one example, the rotatable element includes at least one surface of spherical shape and at least two ports and one cavity.

In one example, the rotatable element includes at least one cavity.

In one example, the detecting means comprises a sensor. In one example, the sensor is positioned and arranged in the wellbore environment and configured to sense at least one physical property of the environment.

In one example, the apparatus includes: at least one means for detecting a plurality of intended changes in at least one physical property of the environment resulting in a detectable signal within the apparatus suitable for processing the signal.

In one example, the activator includes a suitable controller disposed within the said apparatus suitable for processing the signal. In one example, the suitable controller is positioned and arranged to receive at least one signal from at least one detecting means and configured to interpret the one or more signals and configured to provide at least one control instruction to the actuator. In one example, the suitable controller compares the at least one signal from at least one detecting means with a predetermined pattern to determine if the controllable element state is desired to be changed to a different desired state. In one example, the suitable controller signals the actuator to actuate the controllable valve based on the comparison of the at least one signal from at least one detecting means with the predetermined pattern.

In one example, the activator further includes a suitable means for restricting the change of the valve state when the said apparatus is in the disabled mode, a means for disabling. In one example, the suitable means includes controlling power to the actuator. In one example, the suitable means includes providing an instruction to actuate a lock.

In one example, the activator includes a means for restricting the movement of the rotatable element when in the said apparatus is in the disabled mode.

In one example, the actuator includes a means for transforming a hydraulic energy from fluid disposed within the wellbore into another form of energy suitable for changing position of the rotatable element. In one example, said another form of energy suitable for changing position of the rotatable element is electricity.

In one example the actuator includes a means for transforming a mechanical energy from tubular string movement within the wellbore into another form of energy suitable for changing position of the rotatable element. In one example, said another form of energy suitable for changing position of the rotatable element is electricity.

In one example, the actuator includes a means for transforming an electrical energy from source on surface through the wellbore into another form of energy suitable for changing position of the rotatable element. In one example, said another form of energy suitable for changing position of the rotatable element is mechanical energy.

In one example, the actuator includes a means for transforming an electrical energy source disposed within the apparatus into another form of energy suitable for changing position of the rotatable element. In one example, said another form of energy suitable for changing position of the rotatable element is mechanical energy.

In one example, the electrical energy source is a battery.

In one example, the electrical energy source is a suitable electric generator. In one example, a suitable electric generator is an electric generator positioned and arranged to receive mechanical energy from the tubular string and is configured to provide electrical energy to the actuator.

In one example, the electrical energy source is a suitable electric generator. In one example, a suitable electric generator is an electric generator positioned and arranged to receive hydraulic energy from fluid in the tubular string and is configured to provide electrical energy to the actuator. In one example, a suitable electric generator is an electric generator positioned and arranged to receive hydraulic energy from a fluid pressure difference between the inner fluid passage and the annular fluid passage.

In one example, the means for powering includes a means for transforming hydraulic energy from fluid in the wellbore.

In an example, the actuator includes a means for transforming a mechanical energy source disposed within the apparatus into another form of energy suitable for changing position of rotatable element.

In an example, the mechanical energy source is an energized resilient element.

In an example, the actuator includes an electric motor.

In one set of examples, disclosed is a method of remotely and selectively controlling an apparatus disposed in a tubular string within a wellbore, the method including: disposing in a wellbore a tubular string including an apparatus, the apparatus including: a body defining boundaries between an inner flow passage through the said apparatus and an annular flow passage within the wellbore annulus and having two suitable end connections; at least one controllable element operable in plurality of desired states; an activator disposed within the body capable of selectively changing the apparatus into either one of two modes: a disabled mode wherein the at least one controllable element is not operable, and an enabled mode wherein the at least one controllable element is operable to a desired state, including a sensor capable of detecting an intended change in a physical property of an environment; and an actuator suitable for changing the at least one controllable element into a desired state; causing a change in a physical property of the environment in certain sequence within a specified period of time resulting in a detectable pattern at the sensor, the change in a physical property comprising a sequence of a plurality of signal variations within a suitable period of time; comparing the said detectable pattern with a command pattern to determine if the controllable element state is desired to be changed to a different desired state and then causing the activator to change the apparatus mode into the suitable mode; and causing the actuator to convert a suitably available energy source, causing the at least one controllable element into the different desired state.

In an example, the change in a physical property of the environment is a mechanical movement of the apparatus by means of moving the tubular string causing the apparatus to move within the wellbore in at least one direction detectable by the said sensor.

In an example, the change in a physical property of the environment is a change of property of fluid introduced from surface into the wellbore detectable by the said sensor.

In an example, the change of physical property includes a change in one or more of the following fluid property: pressure, temperature, flow rate, density, viscosity, color, composition or another physical change detectable by the said sensor.

In an example, the change in a physical property of the environment is a change of electromagnetic field detectable by the said sensor.

In an example, the change in a physical property of the environment is a change of electric field detectable by the said sensor.

In an example, the controllable element is a valve.

In a set of examples, disclosed is a method for remotely and selectively control fluid flow in a tubular string and wellbore annulus, the method including: disposing a tubular string into a wellbore comprising at least one flow control apparatus, the apparatus including: a body defining boundaries between an inner flow passage through the said apparatus and an annular flow passage within the wellbore annulus and having two suitable end connections and at least one lateral hole suitable for connecting the inner flow passage and the annular flow passage; a controllable valve operable in a plurality of desired states altering the fluid flow pattern within the wellbore, where the valve includes at least one rotatable element having plurality of surfaces, where the rotatable element is rotatable to a plurality of desired positions, where the valve further divides the inner flow passage into an upstream section and a downstream section, where the upstream section is the portion of the inner flow passage from the valve and through one end connection of the body and the downstream section is the portion of the inner flow passage from the valve and through the other end connection of the body; an activator disposed within the body capable of selectively changing the apparatus into either one of two modes: a disabled mode, where the valve is not operable, and an enabled mode, where the valve is operable to a desired state, including a means responsive to an intended change in the environment; and an actuator capable of changing the position of the rotatable element to cause the valve into a desired state, including a means for transforming a suitably available energy source into a mechanical movement; causing a plurality of changes in one or more physical property of the environment within a specified period of time resulting in a detectable pattern at the sensor comprising a plurality of signal variations within a suitable period of time; comparing the detectable pattern with a command pattern to determine if the valve state is desired to be changed to a different desired state and then causing the activator to cause the apparatus mode into the desired mode; causing the actuator to change the rotatable element position to cause the valve into a different state resulting in a change of the fluid flow pattern by the desired apparatus into a desired flow pattern.

In one example, disclosed is method for remotely and selectively controlling fluid flow in a tubular string and wellbore annulus, the method including: disposing a tubular string into a wellbore comprising at least one flow control apparatus, the apparatus including: a body, an inner passage through the body, an orifice disposed on a lateral side of the body, a valve having a movable element, the valve disposed in fluid communication with the inner passage and the orifice; changing at least one physical property in the environment in the wellbore; sensing the change in the at least one physical property in the environment; disabling movement of the valve element in response to a predetermined sensed change; enabling movement of the valve element in response to a predetermined sensed change; actuating the valve in response to a predetermined sensed change when movement of the valve is enabled.

In one example, the movable element is positioned and arranged upon actuation of the valve into a predetermined position selected form the set of positions including: restricted fluid flow through the inner flow passage and restricted flow between the inner flow passage and the annular flow passage through the orifice, fluid flow communication through the inner flow passage and restricted fluid flow between the inner flow passage and the annular flow passage through the orifice; fluid flow communication between the first end of the body and the annular flow passage and restricted flow between the second end of the body and the annular flow passage; and fluid flow communication between the first end of the body and the annular flow passage and flow communication between the second end of the body and the annular flow passage In one example, disclosed is a method for remotely and selectively controlling fluid flow in a tubular string and wellbore annulus, the method including: disposing a tubular string into a wellbore comprising at least one flow control apparatus, the apparatus including: a body, an inner flow passage through the body, an orifice disposed on a lateral side of the body, a valve having a movable element, the element movable to a plurality of predetermined positions, the valve disposed in fluid communication with the annular passage and the orifice; actuating the moveable element into at least one of the plurality of predetermined positions; disabling movement of the moveable element; detecting at least one change in at least one physical property in an environmental condition within the wellbore; decoding at least one instruction from the at least one detected change in the environmental condition; where the disabling movement of the moveable element is responsive to a decoded instruction of the at least one decoded instruction; and where the actuating the valve element into the at least one of the plurality of predetermined positions is responsive to a decoded instruction of the at least one decoded instruction.

BRIEF DESCRIPTION OF THE DRAWINGS

A complete understanding of the present invention may be obtained by reference to the accompanying drawings, when considered in conjunction with the subsequent, detailed description, in which:

FIGS. 7A1 through 7D1 and 7A2 through 7D2 and 7E are detail views of an example of a flow passage caused by having an example rotatable element disposed in different possible positions within the valve body, the example rotatable element having a curved outer surface;

FIGS. 8A1 through 8C1 and 8A2 through 8C2 are detail views of an example of a flow passage caused by having an example rotatable element disposed in different possible positions within the valve body, the example rotatable element is a form of a two ports rotatable element comprising a spherical surface and having two ports and one cavity connecting the two ports;

FIGS. 9A1 through 9C1 and 9A2 through 9C2 are detail views of an example of a flow passage caused by having an example rotatable element disposed in different possible positions within the valve body, the example rotatable element is a form of a cylindrical shaped rotatable element having two ports and one cavity connecting the two ports;

FIGS. 10A1 through 10C1 and 10A2 through 10C2 and 10A3 through 10C3 are detail views of an example of a flow passage caused by having an example rotatable element disposed in different possible positions within the valve body, the example rotatable element is a form of a three ports rotatable element comprising a spherical surface and having three ports and one cavity connecting the three ports;

FIG. 20A is a view of the apparatus during no circulation. FIG. 20B is a view of the apparatus during transition between no circulation and mud circulation. FIG. 20C is a view of the apparatus during mud circulation;

For purposes of clarity and brevity, like elements and components will bear the same designations and numbering throughout the Figures.

DETAILED DESCRIPTION

U.S. Provisional Application No. 61/710,887, filed Oct. 8, 2012 for METHOD AND APPARATUS TO CONTROL THE MUD FLOW IN DRILL STRINGS AND WELLBORE ANNULUS, by Ahmed TAHOUN, Raed Kafafy, Karam Jawamir, Mohamed Aldheeb, Abdul Mushawwir Mohamad Khalil is herein incorporated by reference in its entirety.

U.S. Provisional Application No. 61/622,572, filed Apr. 11, 2012 for METHOD AND APPARATUS OF CONTROL DRILLING FLUID LOSSES AND IMPROVED HOLE CLEANING IN OIL & GAS SUBTERRANEAN DRILLING OPERATIONS, by Ahmed Moustafa Tahoun is herein incorporated by reference in its entirety.

U.S. Provisional Application No. 61/710,823, filed Oct. 8, 2012 for METHOD AND APPARATUS TO HARVEST ENERGY INSIDE WELLBORE FROM CHANGE OF FLUID FLOW RATE, by Ahmed M. Tahoun, Raed I. Kafafy, Karam Jawamir, Mohamed A. Aldheeb, Abdul M. Khalil is herein incorporated by reference in its entirety.

Figure 1:
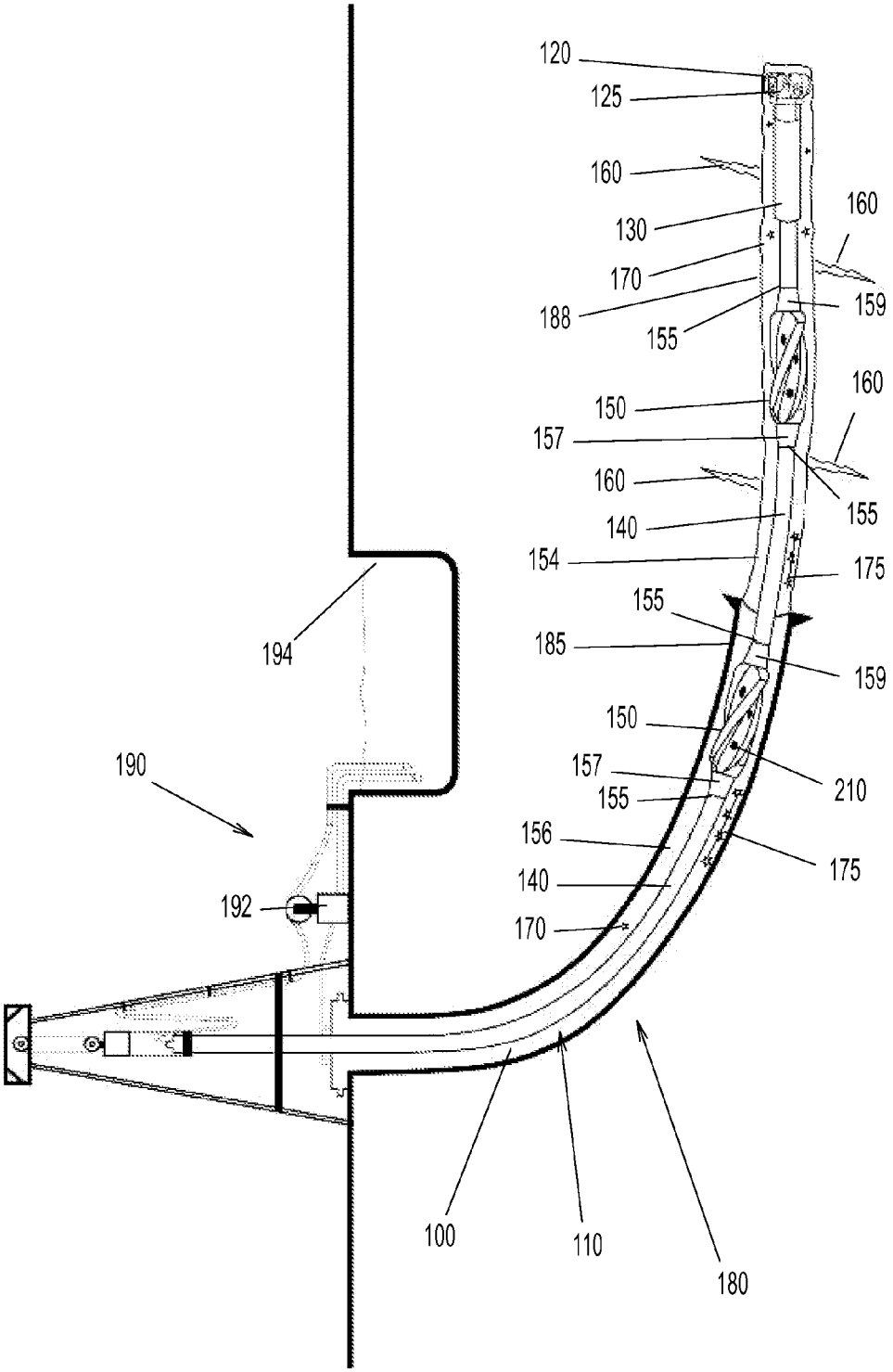
FIG. 1 is a section view of an example of a wellbore drilling system wherein a plurality of the fluid flow control apparatus are disposed within drilling tubular string.

FIG. 1 is a section view of an example of a wellbore 100 drilling system wherein a plurality of the fluid flow control apparatus 150 are disposed within drilling tubular string 110 during well forming operation. Majority of drilling systems used in current days include a tubular string 110 composed of a drill bit 120 having a plurality of perforations 125 located through the drill bit 120 to allow fluid flow there through. A heavy tubular with bigger outer diameter among other equipment such as mud motors or logging while drilling equipment or directional drilling control systems, or any combination thereof that is frequently called bottom hole assembly 130 connected to the drill bit 120 from one end. Bottom hole assembly 130 is normally connected by form of thread from the other end to other tubular conduit such as drill pipe 140 connecting the bottom hole assembly 130 to surface. The drill pipe 140 outer diameter is commonly known to be smaller when compared to the bottom hole assembly 130, therefore the annular volume surrounding the drill pipe 140 within the wellbore 100 over any particular length is larger than the annular volume surrounding the bottom hole assembly 130 of equivalent length within the wellbore 100. Plurality of fluid flow control apparatus 150 disposed within the wellbore 100 are connected to a portion of the tubular string 110 by a suitable means normally a form of thread on each end connection 155 of the flow control apparatus 150. The wellbore 100 formed into the earth may have a deviated section 180 where the wellbore 100 is not vertical. A cased hole 185 section is the portion of the wellbore 100 having a tubular of large diameter called casing lining the inner side of the wellbore 100 to protect wellbore 100 from damage. While drilling a deeper section into earth formations an open hole 188 section of the wellbore 100 is formed. A surface mud pumping system 190 is disposed with most drilling operations and includes a drilling fluid tank 194 to store drilling fluid and a pump 192 to force fluid into the inner flow passage 152 defined as the inner space within the tubular string 110. Cuttings 170 generated from hole making are carried out through the annular flow passage 154. An annular flow passage 154 is defined as the space between the inner wall of the wellbore 100 and the outer wall of the tubular string 110. Cutting beds 175 are sometimes formed by accumulation of cuttings 170 deposited normally at the lower side of wellbore 100 particularly in deviated section 180 of open hole 188 or cased hole 185 of wellbore 100. Plurality of fractures 160 connected to wellbore 100 may naturally exist or formed during the drilling operations. When fractures 160 exist in a wellbore 100, they may act as a passage causing a portion of drilling fluid to flow into earth formation causing what is commonly known as losses. When losses are encountered, well control is compromised and drilling operation risks and costs are increased. The flow control apparatus 150 comprises a valve 220. the said valve 220 further divides the inner flow passage 152 into upstream 157 section and downstream 159 section where upstream 157 section is defined as the portion of the inner flow passage 152 from the valve 220 and through the upstream 157 end connection 155 of the flow control apparatus 150 and the downstream 159 section as defined as the portion of the inner flow passage 152 from the valve 220 and through the downstream 159 end connection 155 of the flow control apparatus 150.

Figure 2:
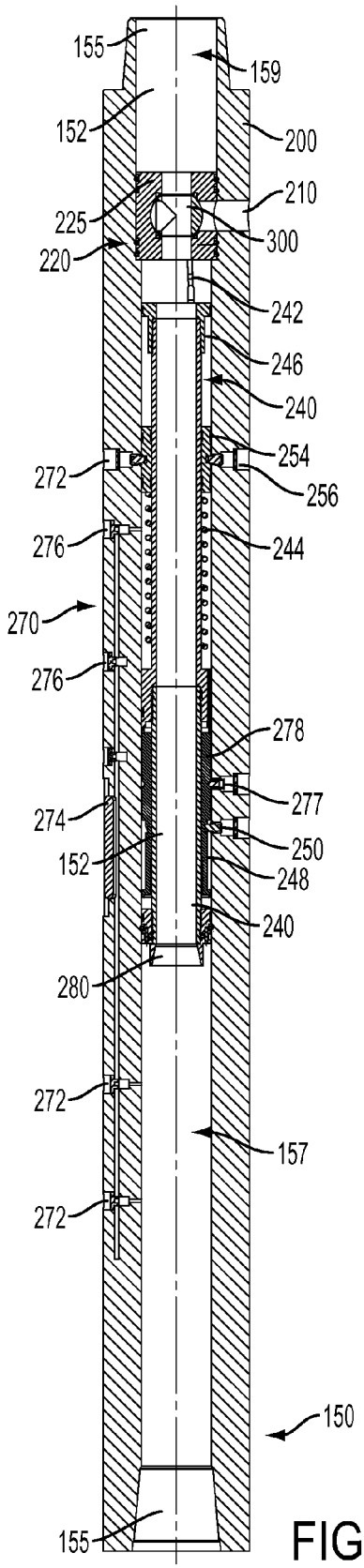
FIG. 2 is a section view of a preferred example of the flow control apparatus.

FIG. 2 is a section view of a preferred example of the flow control apparatus 150 comprising a body 200 defining the boundaries between an inner flow passage 152 through the said apparatus and the annular flow passage 154 within the wellbore annulus 156 and having a suitable connecting means such as a form of thread to connect the apparatus body 200 to a portion of the tubular string 110 through an end connection 155 disposed on each end connection 155 of the said body 200. One of the end connections is the upstream 157 end connection 155, and the other end connection 155 is the downstream 159 end connection 155. The said body 200 further comprises one or more lateral hole 210 suitable for connecting the inner flow passage 152 to the annular flow passage 154. The flow control apparatus 150 further comprises a valve 220. The valve 220 is the element of the flow control apparatus 150 which allows or restricts the flow connectivity between the upstream 157 section, the downstream 159 section, the inner flow passage 152 and the lateral hole 210 connecting to the annular flow passage 154. In one example, valve 220 is composed of a valve housing 225 and a plurality of rotatable elements. In one example, valve housing 225 is an integral part of the body 200. In another example, valve housing 225 is a separate member element inserted into an inner space of the body 200. In one example, a rotatable element 300 is disposed in valve housing 225. The rotatable element 300 is suitable to be rotated into a plurality of positions. Each position taken by the rotatable element 300 causes the valve 220 to be in a state suitable to connect the said flow passages to establish a particular flow pattern within the flow control apparatus 150, hence wellbore 100 as will be explained later when describing FIGS. 7, 8, 9 and 10.

In one example, flow control apparatus 150 further comprises an actuator 240 capable of transforming a suitably available energy into a mechanical energy suitable for rotating the rotatable element 300 into a desired position. By way of example, the actuator 240 in this figure is composed of an actuation mandrel 246 disposed within the body 200 and movable with respect to the body 200. The said actuation mandrel 246 is having an inner surface that is forming part of the inner flow passage 152 and is having a flow orifice 280 profile suitable to be affected by the fluid flowing through the inner flow passage 152. When a fluid flows through the actuation mandrel 246 the hydraulic energy from the said fluid flow exerts a suitable force on the flow orifice 280 causing the actuation mandrel 246 to move with respect to the body 200 and exert a suitable force on the actuation linkage 242 suitably attached to the rotatable element 300 push-pull point 308 causing the rotatable element 300 to rotate and change its position.

In one example, the actuation mandrel 246 is suitably attached to a resilient element such as a spring 244. When the actuation mandrel 246 moves by effect of hydraulic energy from fluid flow, it pushes the resilient element in a suitable direction that causes it to deform and build strain energy which is stored within the said resilient element. When the resilient element is allowed to relax and deform back to the previous shape, it will release the said stored strain energy into a mechanical movement that is suitable for the actuation mandrel 246 to utilize to perform the desired actuation. The above is a demonstration of the actuator 240 causing a transformation of hydraulic energy from fluid flowing through the wellbore 100 inner flow passage 152 to a mechanical energy in the form of actuation mandrel 246 movement. The above is a further demonstration of the actuator 240 causing a transformation of mechanical energy originating from actuation mandrel 246 movement into another form of energy such as strain energy stored within a suitable resilient element located within the apparatus. The spring 244 form of the resilient element is held on the other end by a spring retainer 254 suitably maintained in its position by a suitable fastener such as a spring retainer bolt 256 connecting the spring retainer 254 to the body 200. The spring 244 form of a resilient element is located within the apparatus to keep the actuation mandrel 246 biased in certain direction.

In one example, the flow control apparatus 150 further comprises an activator 270. The activator 270 includes a means of detecting a physical change in the environment using one or more sensor 272, in one example, disposed within the said apparatus. The said sensor 272 is capable of being affected by intended change in one or more physical property of the environment caused by action initiated on surface by the operator.

In one example, activator 270 further comprises a locking means to put the flow control apparatus 150 into either enabled mode or disabled mode. In the enabled mode, the actuator 240 within the said flow control apparatus 150 will be operable, whereas in the disabled mode, the actuator 240 within the said flow control apparatus 150 is inoperable. In one example, the locking means comprises a lock 277 element such that when engaged with a suitable locking groove 278 suitably connected to the actuation mandrel 246, it will restrict the movement of one or more of the actuator 240 elements such as the actuation mandrel 246 and cause the flow control apparatus 150 to be in a disabled mode. When the apparatus is in disabled mode, the valve 220 is not operable to change its state. When the lock 277 is disengaged from the locking groove 278, the actuator 240 disposed within the flow control apparatus 150 will not be restricted by the lock 277 element and the flow control apparatus 150 will be in enabled mode and the valve 220 will be operable into a different state.

In one example, the activator 270 further comprises a controller 274 suitable to analyze the signal output of the sensor 272 and compare it to a command pattern 899 to determine the desired mode then cause suitable changes within the activator 270, thus providing a means for decoding signals from one or more sensors. In one example, controller 274 is an electronic computational device having interface electronics to the sensor(s) and memory to store command pattern 899 and computational instructions to perform the comparison. In one example, command pattern is programmable. The said controller 274 comprises a movement limiting means to limit the actuation linkage 242 movement and cause it to stop after a desired displacement. In one example, the movement limiting means of movement control comprises a barrel cam 248 disposed within the body 200 and suitably connected to the actuation mandrel 246. The said barrel cam 248 comprises a cam track 740 with a profile suitable for a cam follower 250 disposed within the body 200 to limit the movement of the barrel cam 248 travel between specific predetermined two or more track point such as those explained in FIG. 13. Any of the said track point restricts the barrel cam 248 displacement from movement in one or more direction. As the barrel cam 248 is suitably connected to the actuation mandrel 246, when the flow control apparatus 150 is in enabled mode, the movement of the barrel cam 248 as determined by the cam follower 250 travelling the cam track 740 causes the actuation mandrel 246 movement to be restricted between specific desired positions.

FIGS. 3A-3D are detail views of examples of a rotatable moveable element 300.

Figure 3A:
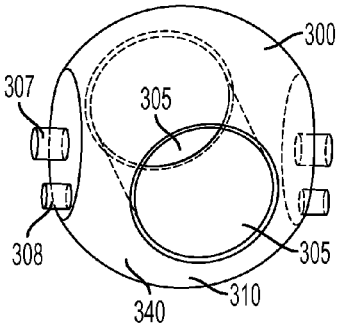
FIGS. 3A-3D are detail views of examples of a rotatable moveable element 300.

FIG. 3A is a view of a two ports rotatable element 310 having at least one spherically formed surface and having one port 305 on its surface and another port 305 on its surface wherein both ports are suitably connected through a cavity within the rotatable element 300.

Figure 3B:
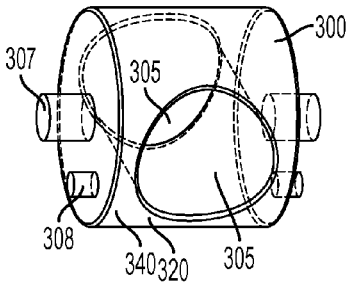

FIG. 3B is a view of a cylindrical rotatable element 320 having at least one surface curved in a cylindrical form, and having one port 305 on its surface and another port 305 on its surface wherein both ports are suitably connected through a cavity within the rotatable element 300.

Figure 3C:
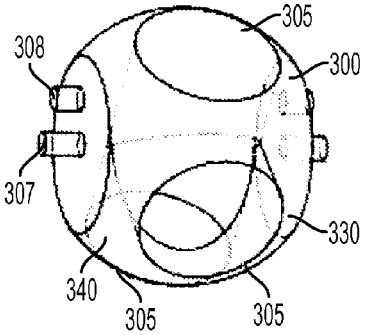

FIG. 3C is a view of a three ports rotatable element 330 having at least one form of a spherical surface and having at least three ports on its surfaces wherein each port 305 is suitably connected to another port 305 through a cavity within the rotatable element 300.

Figure 3D:
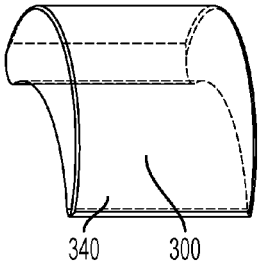

FIG. 3D is a view of a general form of a possible embodiment of a rotatable element 300 having at least one outer surface 340 suitable to engage with one or more fluid flow passage such as the inner flow passage 152, upstream 157 section, downstream 159 section and a lateral hole 210 connecting to the annular flow passage 154.

Figure 4:
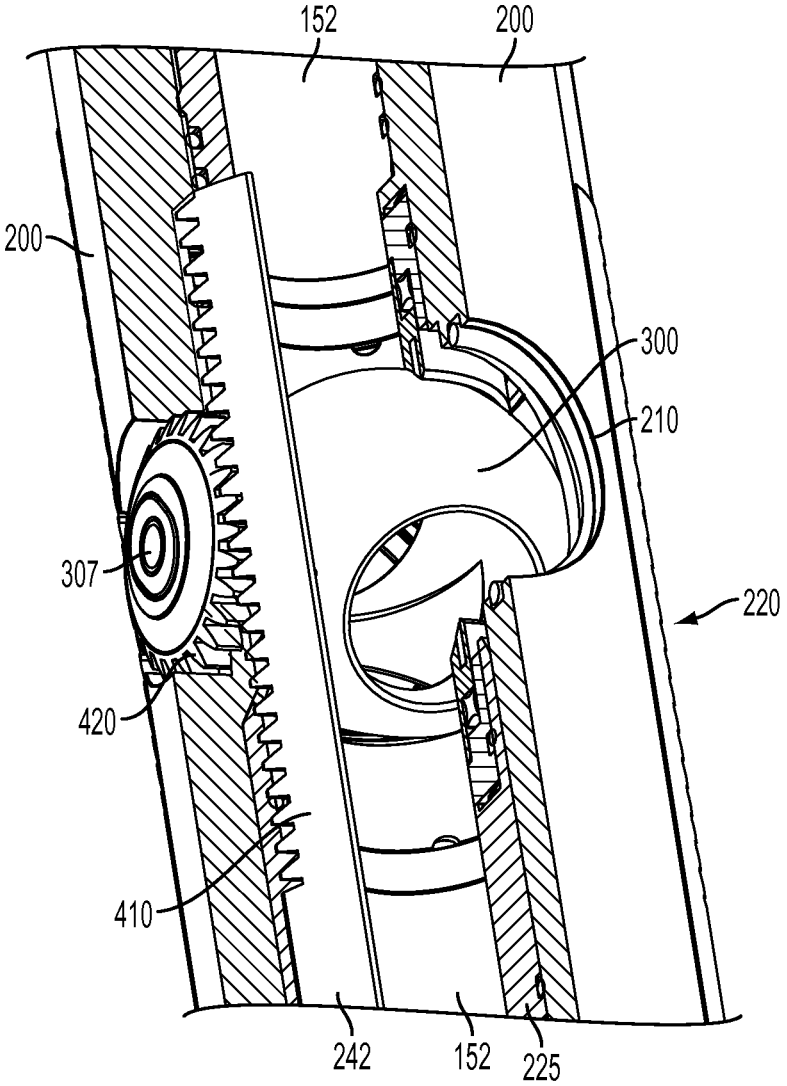
FIG. 4 is a perspective cutaway view of an example of an actuator in a form of rack and pinion.

FIG. 4 is a perspective cutaway view of an example of an actuator in a form of rack and pinion. Actuation linkage 242 causes rotatable element 300 to change position using a rack 410 and a pinion 420, where at least one pinion 420 is suitably connected to the rotatable element 300 and at least one rack 410 is connected to the actuation mandrel 246 and both the rack 410 and the pinion 420 are suitably engaged so that when the rack 410 moves in certain direction the pinion 420 rotates around a suitably located pivot 307. Engagement between rack 410 and pinion 420 is commonly formed by way of a matching thread however other forms are also possible, such as by way of example, a friction surface or a magnetic coupling. In this figure the valve 220 is composed of a valve housing 225 located inside the body 200 and the rotatable element 300 is in the form of three ports rotatable element 330 explained earlier.

Figure 5:
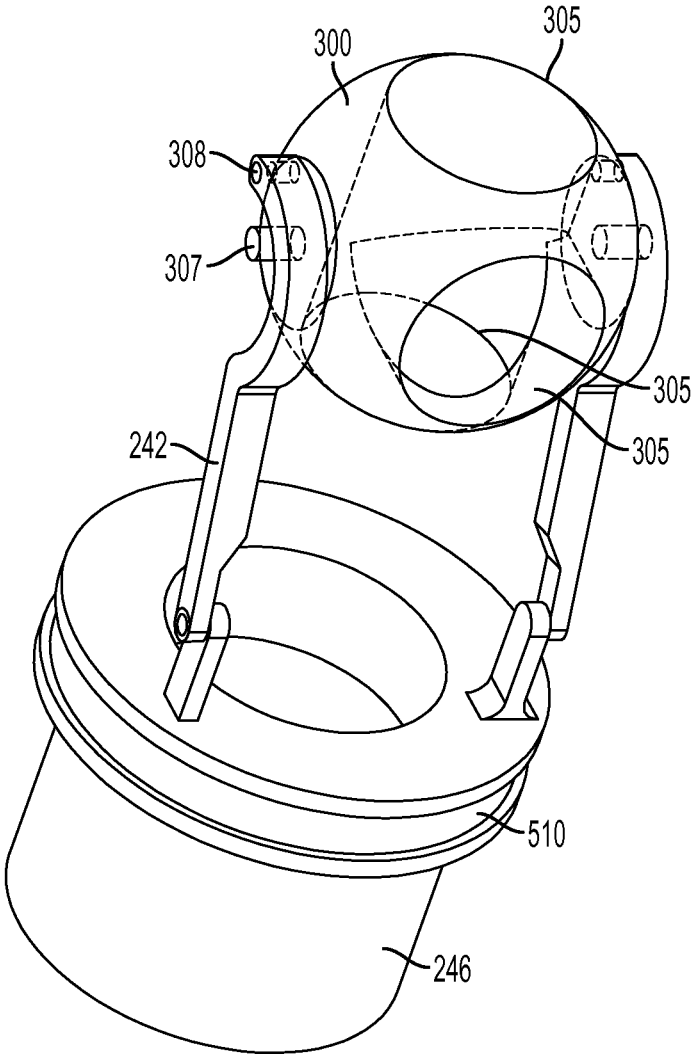
FIG. 5 is a detail view of an example of an actuator linkage and mechanical energy source.

FIG. 5 is a detail view of an example of an actuator linkage and mechanical energy source. Actuation linkage 242 is configured, positioned, and arranged to cause rotatable element 300 to change position. In this figure, movement of the actuation mandrel 246 in a suitable direction causes the actuation linkage 242 to exert a suitable force on a push-pull point 308 causing the rotatable element 300 to change position. An inertia element 510 is disposed within the actuation mandrel 246 having a suitable mass capable of storing kinetic energy in proportion to its mass and speed of movement.

When the tubular string 110 moves in certain direction, such as when moved along the wellbore 100 axis by pulling in the direction out of wellbore 100 to earth surface or lowering it deeper into earth through the wellbore 100, the flow control apparatus 150 follows the same movement as it is rigidly connected at its end connection 155 through a form of thread to a portion of the tubular string 110 and causing elements disposed within the flow control apparatus 150 to follow the same movement as the tubular string 110. The inertia element 510 will store kinetic energy in proportion to its mass and to its movement speed and accordingly to the movement speed of the tubular string 110. When tubular string 110 movement changes, the inertia element 510 will lag the change of movement in time before it follows the new movement of the tubular string 110, due to its stored kinetic energy. When the flow control apparatus 150 is in enabled mode, the change of energy stored in inertia element 510 due to change in tubular string 110 movement can cause movement of the actuation mandrel 246 in a suitable direction, causing the rotatable element 300 to change position. In one example, in the case when the tubular string 110 is lowered into earth formation and then stops, a change of movement occurs. The kinetic energy stored within the inertia element 510 will cause inertia element 510 to continue movement in the original direction if the flow control apparatus 150 is in enabled mode. In one example, this movement is transformed into a mechanical movement to cause the change of rotatable element 300 position. In one example, inertia element 510 represents an energy source disposed within the actuator 240 having a means of transforming mechanical energy from tubular string 110 movement within the wellbore 100 into mechanical energy capable of operating the said valve 220.

Figure 6:
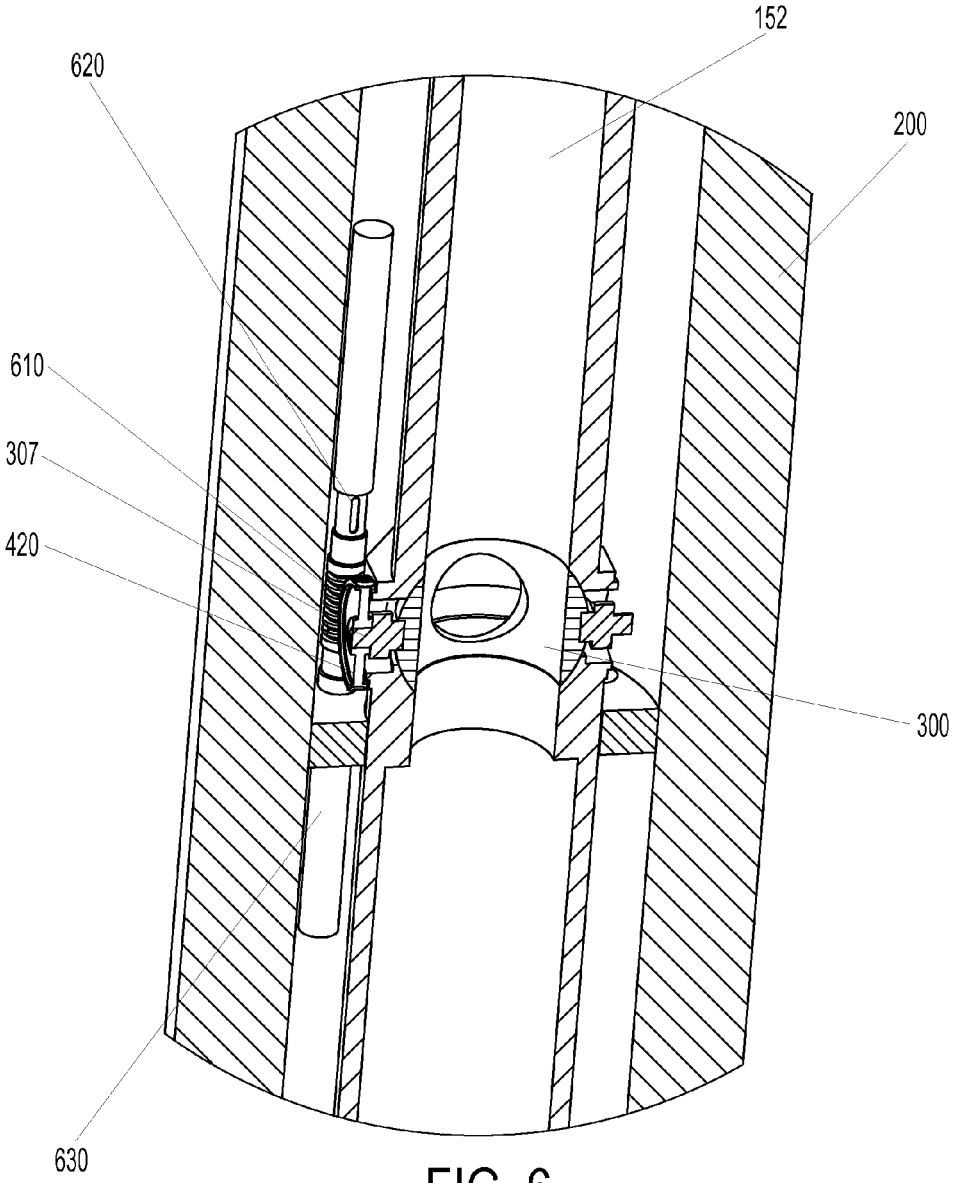
FIG. 6 is a section view of an example of an actuator and energy source disposed within the flow control apparatus body.

FIG. 6 is a section view of an example of an actuator and energy source disposed within the flow control apparatus body. In this example, actuator 240 includes an electric motor 620 as means of transforming a suitably available electrical energy source into a mechanical energy capable of changing the position of the rotatable element 300 by means of linkage in the form of a suitable gear engagement such as worm gear 610 and pinion 420. When the suitable electric energy source is connected to the electric motor 620, electric motor 620 causes the worm gear 610, connected to the electric motor 620 output, to adequately rotate the pinion 420 that is suitably connected to the rotatable element 300 around the pivot 307, as a result changing the rotatable element 300 position. In this figure, in one example, an alternative energy source is disposed within the said apparatus in a form of an energized resilient element as means of mechanical energy source disposed within the apparatus. An energized spring 630, in one example, such as a strained coiled spring 244 or other form of strained resilient element, is suitably connected to the pinion 420 by means of a suitable linkage such as a worm gear 610.

When the flow control apparatus 150 is enabled, stored mechanical energy disposed within the energized spring 630 that is allowed to relax to a less strained state by releasing strain energy into mechanical movement, causing the worm gear 610 to adequately move the pinion 420 that is suitably connected to the rotatable element 300 around the pivot 307 and, as a result, changing the rotatable element 300 position. The example explained above of strain energy stored in a resilient element is similar to the energy stored in a watch winding spring explained by Dawson in U.S. Pat. No. 163, 161, issued May 11, 1875.

In one example, a means of transforming mechanical energy source disposed within the said apparatus in a form of and energized resilient element is explained. In one example, a means of transforming electrical energy source disposed within the said apparatus is a form of electric motor. The electric motor 620 is suitable for transforming an electrical energy from a suitable electrical energy source disposed within the flow control apparatus 150 in a form of suitable battery 276 or an electric generator.

In one example, an electric generator is in the form of a turbine, transforming hydraulic fluid flowing through the wellbore 100 into electrical power as a source to be used directly or stored in a form of electrical storage such as rechargeable battery 276 or a capacitor. In one example, the electrical energy source is disposed within the tubular string 110 or, in another example, in the bottom hole assembly 130. In one example, the electrical energy source is on surface in a form of battery 276 or, in another example, from an electric line from domestic energy source or, in another example, from a drilling system electric generator. In one example, electrical energy sources not disposed within the flow control apparatus 150 are connected to the said apparatus actuator 240 by a connecting means such as wireline cable commonly used for wireline services in the oil well, made by companies such as Schlumberger or Halliburton, and other electric wireline service providers.

FIGS. 7A1 through 7D1 and 7A2 through 7D2 and 7E are detail views of an example of a flow passage caused by having an example rotatable element disposed in different possible positions within the valve body, the example rotatable element having a curved outer surface. In this example, valve 220 is presented in different states by way of presenting the rotatable element 300 in different positions. The valve 220 is capable of forming one of more possible flow passage 700.

FIG. 7A1 is a section view and FIG. 7A2 is a perspective cutaway view of the valve 220 in one state where the rotatable element 300 is in a position such that it restricts flow passage between the inner flow passage 152 and the annular flow passage 154 by way of aligning the outer surface 340 to obstruct flow passage between the inner flow passage 152 and the lateral hole 210. The rotatable element 300 in this position further restrict flow passage within the inner flow passage 152 between the upstream 157 section and downstream 159 section passages by way of aligning the outer surface 340 to obstruct the inner flow passage 152 between the upstream 157 section and downstream 159 section. These figures demonstrate the "no flow" pattern wherein the flow passage between the upstream 157 section and the downstream 159 section is restricted and the flow passage between the inner flow passage 152 and the annular flow passage 154 is also restricted.

FIG. 7B1 is a section view and FIG. 7B2 is a perspective cutaway view of the valve 220 in one state where the rotatable element 300 is in a position such that it restricts flow passage between the inner flow passage 152 and the annular flow passage 154 by way of aligning the outer surface 340 to obstruct the flow passage between the inner flow passage 152 and the lateral hole 210. The rotatable element 300 in this position does not restrict flow passage within the inner flow passage 152 between the upstream 157 section and downstream 159 section by way of aligning the outer surface 340 such that the inner flow passage 152 between the upstream 157 section and downstream 159 section is not obstructed. These figures demonstrate the "through flow" pattern 705 wherein the passage between the upstream 157 section and the downstream 159 section of the inner flow passage 152 is not restricted whereas the passage between the inner flow passage 152 and the annular flow passages is restricted.

FIG. 7C1 is a section view and FIG. 7C2 is a perspective cutaway view of the valve 220 in one state where the rotatable element 300 is in a position such that one portion of the inner flow passage 152 is connected with the annular flow passage 154 by way of aligning the outer surface 340 such that it does not obstruct flow passage between one portion of the inner flow passage 152 and the annular flow passage 154 through the lateral hole 210. The rotatable element 300 in this position further restricts flow passage within the inner flow passage 152 between the upstream 157 section and downstream 159 section passages by way of aligning the outer surface 340 such that the inner flow passage 152 between the upstream 157 section and downstream 159 section is obstructed. These figures demonstrate the diverted flow pattern 710 wherein the flow passage between the upstream 157 section and the annular flow passage 154 is not restricted whereas the flow passage to the downstream 159 section is restricted.

FIG. 7D1 is a section view and FIG. 7D2 is a perspective cutaway view of the valve 220 in one state where the rotatable element 300 is in a position such that the inner flow passage 152 is connected with the annular flow passage 154 through the lateral hole 210 by way of aligning the rotatable element 300 outer surface 340 such that it does not obstruct flow passage between the inner flow passage 152 and the lateral hole 210. The rotatable element 300 in this position further does not restrict flow passage within the inner flow passage 152 between the upstream 157 section and downstream 159 section by way of aligning the outer surface 340 such that the inner flow passage 152 between the upstream 157 section and downstream 159 section is not obstructed. These figures demonstrate the full flow pattern 715 wherein the flow passage between the upstream 157 section and the downstream 159 section of the inner flow passage 152 is not restricted and the flow passage between the inner flow passage 152 and the annular flow passages is also not restricted.

FIG. 7E shows a perspective view of an example of rotatable element 300 having a crescent-moon shape about an intended axis of rotation, forming a three-dimensional prism body in the longitudinal direction along this intended axis of rotation. In one example, a portion of the element having a cylindrical surface is sufficient.

FIGS. 8A1 through 8C1 and 8A2 through 8C2 are detail views of an example of a flow passage caused by having an example rotatable element disposed in different possible positions within the valve body, the example rotatable element is a form of a two ports rotatable element comprising a spherical surface and having two ports and one cavity connecting the two ports. In this example, valve 220 is presented in different states by way of showing the rotatable element 300 in different positions. In these figures, the rotatable element 300 is in the form of two ports rotatable element 310.

FIG. 8A1 is a section view and FIG. 8A2 is a perspective cutaway view of the valve 220 in one state where the rotatable element 300 is in a position such that it restricts flow passage between the inner flow passage 152 and the annular flow passage 154 by way of aligning the outer surface 340 to obstruct the flow passage between the inner flow passage 152 and the lateral hole 210. The rotatable element 300 in this position does not restrict flow passage within the inner flow passage 152 between the upstream 157 section and downstream 159 section by way of aligning the outer surface 340 such that the inner flow passage 152 between the upstream 157 section and downstream 159 section is not obstructed. This figure demonstrate the through flow pattern 705 wherein the passage between the upstream 157 section and the downstream 159 section of the inner flow passage 152 is not restricted whereas the passage between the inner flow passage 152 and the annular flow passages is restricted.

FIG. 8B1 is a section view and FIG. 8B2 is a perspective cutaway view of the valve 220 in one state where the rotatable element 300 is in a position such that one portion of the inner flow passage 152 is connected with the annular flow passage 154 by way of aligning the outer surface 340 such that it does not obstruct flow passage between one portion of the inner flow passage 152 and the annular flow passage 154 through the lateral hole 210. The rotatable element 300 in this position further restrict flow passage within the inner flow passage 152 between the upstream 157 section and downstream 159 section passages by way of aligning the outer surface 340 to such that the inner flow passage 152 between the upstream 157 section and downstream 159 section is obstructed. These figures demonstrate the diverted flow pattern 710 wherein the flow passage between the upstream 157 section and the annular flow passage 154 is not restricted whereas the flow passage to the downstream 159 section is restricted.

FIG. 8C1 is a section view and FIG. 8C2 is a perspective cutaway view of the valve 220 in one state where the rotatable element 300 is in a position such that the inner flow passage 152 is connected with the annular flow passage 154 through the lateral hole 210 by way of aligning the rotatable element 300 outer surface 340 such that it does not obstruct flow passage between the inner flow passage 152 and the lateral hole 210. The rotatable element 300 in this position further does not restrict flow passage within the inner flow passage 152 between the upstream 157 section and downstream 159 section passages by way of aligning the outer surface 340 such that the inner flow passage 152 between the upstream 157 section and downstream 159 section is not obstructed. These figures demonstrate the full flow pattern 715 wherein the flow passage between the upstream 157 section and the downstream 159 section of the inner flow passage 152 is not restricted and the flow passage between the inner flow passage 152 and the annular flow passages is not restricted.

FIGS. 9A1 through 9C1 and 9A2 through 9C2 are detail views of an example of a flow passage caused by having an example rotatable element disposed in different possible positions within the valve body, the example rotatable element is a form of a cylindrical shaped rotatable element having two ports and one cavity connecting the two ports. In this example, valve 220 is presented in different states by way of showing the rotatable element 300 in different positions. In these figures, the rotatable element 300 is in the form of a cylindrical shaped rotatable element 300.

FIG. 9A1 is a section view and FIG. 9A2 is a perspective cutaway view of the valve 220 in one state where the rotatable element 300 is in a position such that it restricts flow passage between the inner flow passage 152 and the annular flow passage 154 by way of aligning the outer surface 340 to obstruct the flow passage between the inner flow passage 152 and the lateral hole 210. The rotatable element 300 in this position does not restrict flow passage within the inner flow passage 152 between the upstream 157 section and downstream 159 section by way of aligning the outer surface 340 such that the inner flow passage 152 between the upstream 157 section and downstream 159 section is not obstructed. These figures demonstrate the "through flow" pattern 705 wherein the passage between the upstream 157 section and the downstream 159 section of the inner flow passage 152 is not restricted whereas the passage between the inner flow passage 152 and the annular flow passages is restricted.

FIG. 9B1 is a section view and FIG. 9B2 is a perspective cutaway view of the valve 220 in one state where the rotatable element 300 is in a position such that one portion of the inner flow passage 152 is connected with the annular flow passage 154 by way of aligning the outer surface 340 such that it does not obstruct flow passage between one portion of the inner flow passage 152 and the annular flow passage 154 through the lateral hole 210. The rotatable element 300 in this position further restrict flow passage within the inner flow passage 152 between the upstream 157 section and downstream 159 section passages by way of aligning the outer surface 340 to such that the inner flow passage 152 between the upstream 157 section and downstream 159 section is obstructed. These figures demonstrate the "diverted flow" pattern 710 wherein the flow passage between the upstream 157 section and the annular flow passage 154 is not restricted whereas the flow passage to the downstream 159 section is restricted.

FIG. 9C1 is a section view and FIG. 9C2 is a perspective cutaway view of the valve 220 in one state where the rotatable element 300 is in a position such that the inner flow passage 152 is connected with the annular flow passage 154 through the lateral hole 210 by way of aligning the rotatable element 300 outer surface 340 such that it does not obstruct flow passage between the inner flow passage 152 and the lateral hole 210. The rotatable element 300 in this position further does not restrict flow passage within the inner flow passage 152 between the upstream 157 section and downstream 159 section passages by way of aligning the outer surface 340 such that the inner flow passage 152 between the upstream 157 section and downstream 159 section is not obstructed. These figures demonstrate the "full flow" pattern 715 wherein the flow passage between the upstream 157 section and the downstream 159 section of the inner flow passage 152 is not restricted and the flow passage between the inner flow passage 152 and the annular flow passages is not restricted.

FIGS. 10A1 through 10C1 and 10A2 through 10C2 and 10A3 through 10C3 are detail views of an example of a flow passage caused by having an example rotatable element disposed in different possible positions within the valve body, the example rotatable element is a form of a three ports rotatable element comprising a spherical surface and having three ports and one cavity connecting the three ports. In this example, valve 220 is presented in different states by way of showing the rotatable element 300 in different positions. In these figures, the rotatable element 300 is in the form of a three ports rotatable element 330.

FIG. 10A1 is a section view and FIG. 10A2 is a perspective cutaway view and FIG. 10A3 is an exploded view of the valve 220 in one state where the rotatable element 300 is in a position such that it restricts flow passage between the inner flow passage 152 and the annular flow passage 154 by way of aligning the outer surface 340 to obstruct the flow passage between the inner flow passage 152 and the lateral hole 210. The rotatable element 300 in this position does not restrict flow passage within the inner flow passage 152 between the upstream 157 section and downstream 159 section by way of aligning the outer surface 340 such that the inner flow passage 152 between the upstream 157 section and downstream 159 section is not obstructed. These figures demonstrate the through flow pattern 705 wherein the passage between the upstream 157 section and the downstream 159 section of the inner flow passage 152 is not restricted whereas the passage between the inner flow passage 152 and the annular flow passages is restricted.

FIG. 10B1 is a section view and FIG. 10B2 is a perspective cutaway view and FIG. 10B3 is an exploded view of the valve 220 in one state where the rotatable element 300 is in a position such that one portion of the inner flow passage 152 is connected with the annular flow passage 154 by way of aligning the outer surface 340 such that it does not obstruct flow passage between one portion of the inner flow passage 152 and the annular flow passage 154 through the lateral hole 210. The rotatable element 300 in this position further restrict flow passage within the inner flow passage 152 between the upstream 157 section and downstream 159 section passages by way of aligning the outer surface 340 to such that the inner flow passage 152 between the upstream 157 section and downstream 159 section is obstructed. These figures demonstrate the diverted flow pattern 710 wherein the flow passage between the upstream 157 section and the annular flow passage 154 is not restricted whereas the flow passage to the downstream 159 section is restricted.

FIG. 10C1 is a section view and FIG. 10C2 is a perspective cutaway view and FIG. 10C3 is an exploded view of the valve 220 in one state where the rotatable element 300 is in a position such that the inner flow passage 152 is connected with the annular flow passage 154 through the lateral hole 210 by way of aligning the rotatable element 300 outer surface 340 such that it does not obstruct flow passage between the inner flow passage 152 and the lateral hole 210. The rotatable element 300 in this position further does not restrict flow passage within the inner flow passage 152 between the upstream 157 section and downstream 159 section passages by way of aligning the outer surface 340 such that the inner flow passage 152 between the upstream 157 section and downstream 159 section is not obstructed. These figures demonstrate the full flow pattern 715 wherein the flow passage between the upstream 157 section and the downstream 159 section of the inner flow passage 152 is not restricted and the flow passage between the inner flow passage 152 and the annular flow passages is not restricted.

Figure 11A:
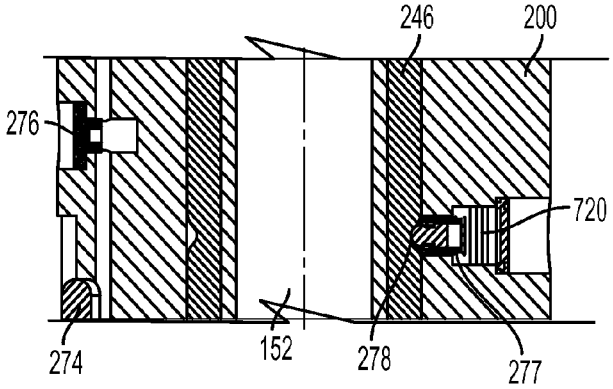
FIGS. 11A, 11B, 11C are section views of an example of the activator when the flow control apparatus is in disabled mode (FIG. 11A), and in enabled mode (FIG. 11B and FIG. 11C)
Figure 11B:
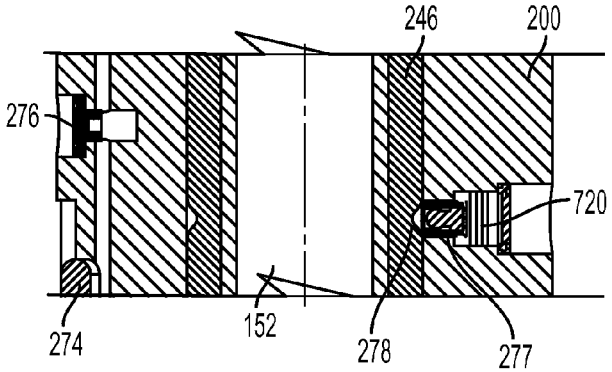
Figure 11C:
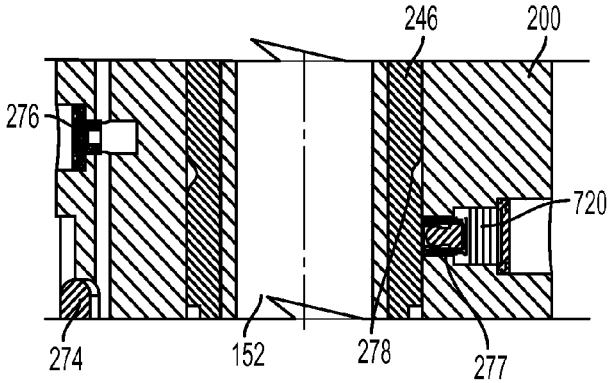

FIGS. 11A, 11B, 11C are section views of an example of the activator when the flow control apparatus is in disabled mode (FIG. 11A), and in enabled mode (FIG. 11B and FIG. 11C). In this example, a locking means causes flow control apparatus 150 into enabled mode or disabled mode. The locking means provides an example of a means for disabling movement of the moveable element 300. By way of example, the locking means comprises at least two elements. One element is a lock 277 element and the other element is a locking profile such as a locking groove 278. One of the elements is disposed in a suitable location within the body 200 and the other element is disposed within a suitable location within an actuator 240 element. The lock 277 is further movable between at least two positions by means of a lock driver 720 suitable to change the lock 277 position from one position to another.

FIG. 11A is a section view of the lock 277 engaged with the locking groove 278.

FIG. 11B is a view of the lock 277 disengaged from the locking groove 278, and FIG. 11C is a view of the lock 277 disengaged from the locking groove 278 and the actuation mandrel 246 moved to a different position. The lock 277 viewed in these figures is caused to change position by a suitable lock driver 720. The lock driver 720, in one example, is a suitable solenoid. In another example, the lock 277 viewed these figures is driven by lock driver 720 in a form of a suitable motor. It is understood that the lock 277 can be driven by other suitable lock driver 720 to cause it to move between at least two positions such that, in one position the lock 277 is disengaged from the locking groove 278, and in another position the lock 277 is suitably engaged the locking groove 278.

In one example, when a suitable electric charge is connected to the solenoid, the solenoid becomes energized causing the lock 277 to retract into the body 200 and the lock 277 is caused to disengage away from the locking groove 278 causing the flow control apparatus 150 into enabled mode. The solenoid is operable such that when energized with a different charge the lock 277 is caused to extend into the inner wall of the body 200 and is caused to be suitably engaged with the locking groove 278 causing the flow control apparatus 150 into a disabled mode.

In one example, the same function made by the solenoid means of lock driver 720 is achieved by a suitable motor or, in another example, by another suitable means, to cause the lock 277 to change position. When the lock 277 is engaged with the suitable locking groove 278 disposed within the actuation mandrel 246, it restricts the movement of the actuation mandrel 246, therefore restricting the movement of the actuation linkage 242. The movement of the rotatable element 300 is therefore restricted and the valve 220 is restricted from changing its state and is not operable into a different state.

The flow control apparatus 150 is said to be in disabled mode when the valve 220 is not operable to a different state. When the lock 277 is disengaged from the locking groove 278, the actuator 240 mandrel disposed within the flow control apparatus 150 will not be restricted by the lock 277 element and the flow control apparatus 150 will be in enabled mode and the valve 220 will be operable into a different state. The flow control apparatus 150 is said to be in enabled mode when the valve 220 is operable to a different state. The locking means explained is by way of example.

In another example of the lock 277 means is explained; in a different example of the actuator 240 such as the example shown in FIG. 6, where the actuator 240 comprises a suitable electric motor 620 is achieved by disconnecting the electric source form the electric motor 620 causing the electric motor 620 to be inoperable and accordingly the rotatable element 300 is restricted from changing position by means of the gear arrangement where the worm engaged with the pinion 420 act as a break when the worm gear 610 is not rotatable, and the flow control apparatus 150 is then said to be in the disabled mode. When the electric motor 620 is connected to the suitable electric energy source, it rotates in certain direction causing the worm gear 610 to rotate and resulting in a change of the rotatable element 300 position and the valve 220 is operable into a different state and the flow control apparatus 150 is said to be in enabled mode.

Figure 12A:
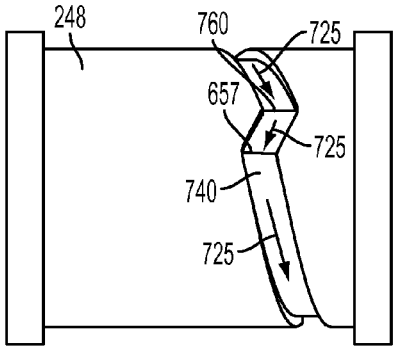
FIGS. 12A, 12B, 12C are barrel cam views from different angles of respective FIGS. 12A, 12B, 12C, showing an example cam track profile.
Figure 12B:
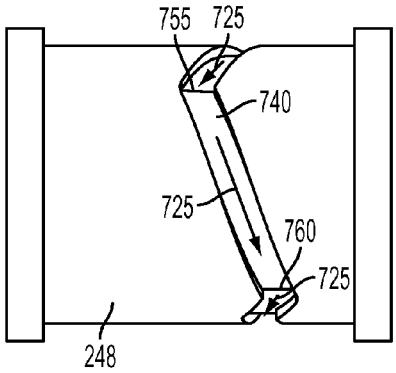
Figure 12C:
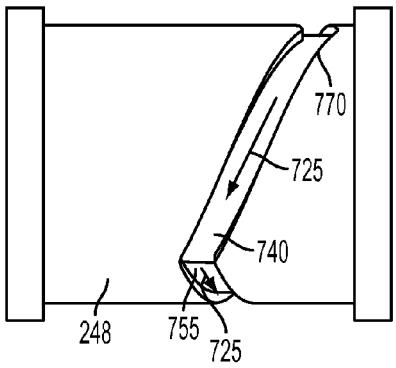

FIGS. 12A, 12B, 12C are barrel cam views from different angles of respective FIGS. 11A, 11B, 11C, showing an example cam track profile. In one example, barrel cam 248 (originally shown in FIG. 2) viewed from different angles in details (FIGS. 11A, 11B, 11C), shows an example cam track 740 profile. The barrel cam 248 comprises a suitable cam track 740 disposed on a curved surface having plurality of stop points. A cam follower 250 suitably disposed within the apparatus such that the cam follower 250 and the barrel cam 248 are movable to each other wherein either the cam follower 250 or the barrel cam 248 is restricted from moving in at least one direction with respect to the body 200.

In one example, the cam follower 250 in FIG. 2 is not movable with respect to the body 200 main axis that is parallel to the wellbore 100 axis, while the barrel cam 248 in FIG. 2 is movable with respect to the cam follower 250 when the actuation mandrel 246 moves within the body 200. The cam track 740 comprises at least one stop point 794 such that when the cam follower 250 traverses the cam track 740 in a traverse direction 725 and passes a stop point 794, the cam follower 250 will be restricted from traversing the cam track 740 in the opposite direction by restriction means such as a step within the cam track 740. In this example, while the barrel cam 248 is moving relative to the body 200, the cam follower 250 traverse the track in the traverse direction 725 from track point 1 (755) to track point 2 (760) then to track point 3 (765) then to track point 4 (770) and then continue traversing the cam track 740 to reach the starting track point 1 (755). Throughout the barrel cam 248 movement is controlled by the cam track 740 profile and the cam follower 250, the axial and rotational movement of the barrel cam 248 suitably mounted on the actuation mandrel 246 result in a controlled movement of the actuation mandrel 246.

Figure 13:
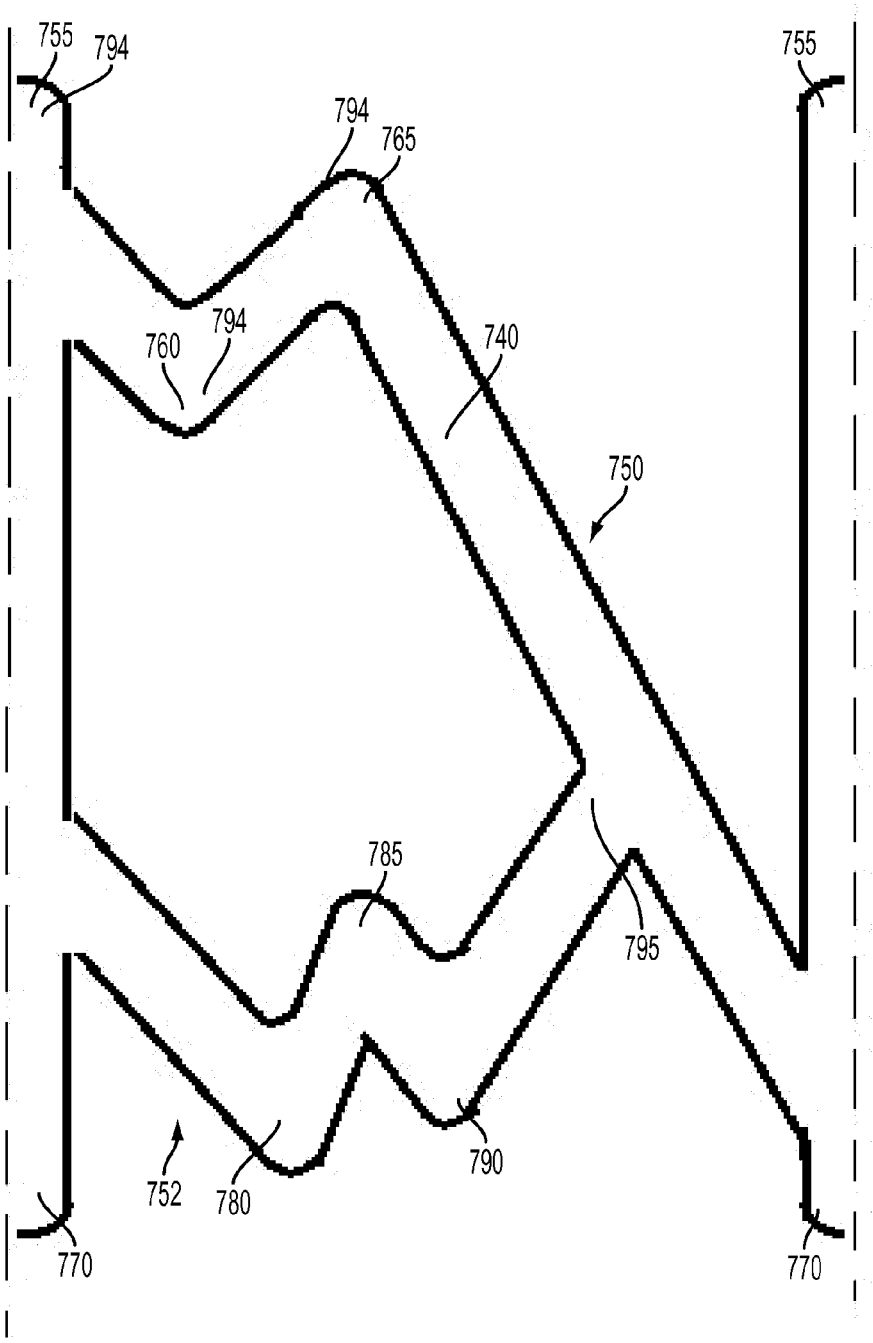
FIG. 13 is a detail view of an example of barrel cam track with a plurality of track passages and a plurality of movement levels.

FIG. 13 is a detail view of an example of a barrel cam track with a plurality of track passages and a plurality of movement levels In this example, cam track 740 is shown as having multiple paths, in this example, showing an upper track 750 and a lower track 752. In one example, each of the upper track 750 and the lower track 752 has at least one stop point 794 suitably located onto the cam track 740 to cause the cam follower 250 traversing the cam track 740 to have a plurality of possible combinations of sequence of stop points. Continuing with this example, in one path, the cam follower 250 traverses the upper track 750 starting from track point 1 (755) then track point 2 (760) followed by track point 3 (765) and track point 4 (770) then to track point 1 (755) when the cam follower 250 fully travers the upper track 750. The cam follower 250 is also suitably controlled to traverse the lower track 752, starting from track point 1 (755) then track point 5 (780) followed by track point 6 (785) then track point 7 (790) then track point 8 (795) then track point 4 (770) and then back to the starting point at track point 1 (755) where the cam follower 250 completes the traverse of the lower track 752. It is understood that this figure demonstrates by way of one example a possible combination of stop points in a cam track 740 where the cam follower 250 traversing the upper track 750 in this example passes by a total of four (4) track stop points, while traversing the lower track 752, the cam follower 250 passes pass by six (6) track stop points before completing the lower track 752 to the starting point. This form of multi cam track 740 is advantageous and desirable in control systems. It is understood that plurality of tracks and plurality of track stop points are possible using this concept.

In one example, the plurality of cam track is a means for decoding the command pattern as explained herein. A change in the environment will cause the cam follower to traverse the cam track for example as the force generated from the hydraulic fluid flowing through the inner flow passage exert force on the actuator, and with the cam mounted on the inner mandrel such that it is movable with the mandrel movement in an axial direction. When cam follower traverse the cam track from track point 1 755 for a particular distance between track point 1 755 and track point 4 770 the cam follower will engage and traverse the upper track 750 following the track points explained earlier. When cam follower traverse the cam track for a different distance between track point 1 755 and track point 4 it will traverse the lower cam track 752. The distance traversed between track point 1 755 and track point 4 770 caused by the movement of the actuator mandrel due to a specific change of the at least one change of the environment will determine the track passage that the cam follower will traverse. Specific change of the environment will control the track traversed by the cam follower and the cam explained in FIG. 13 is an example of a means for decoding the at least one change in the environment.

Figure 14:
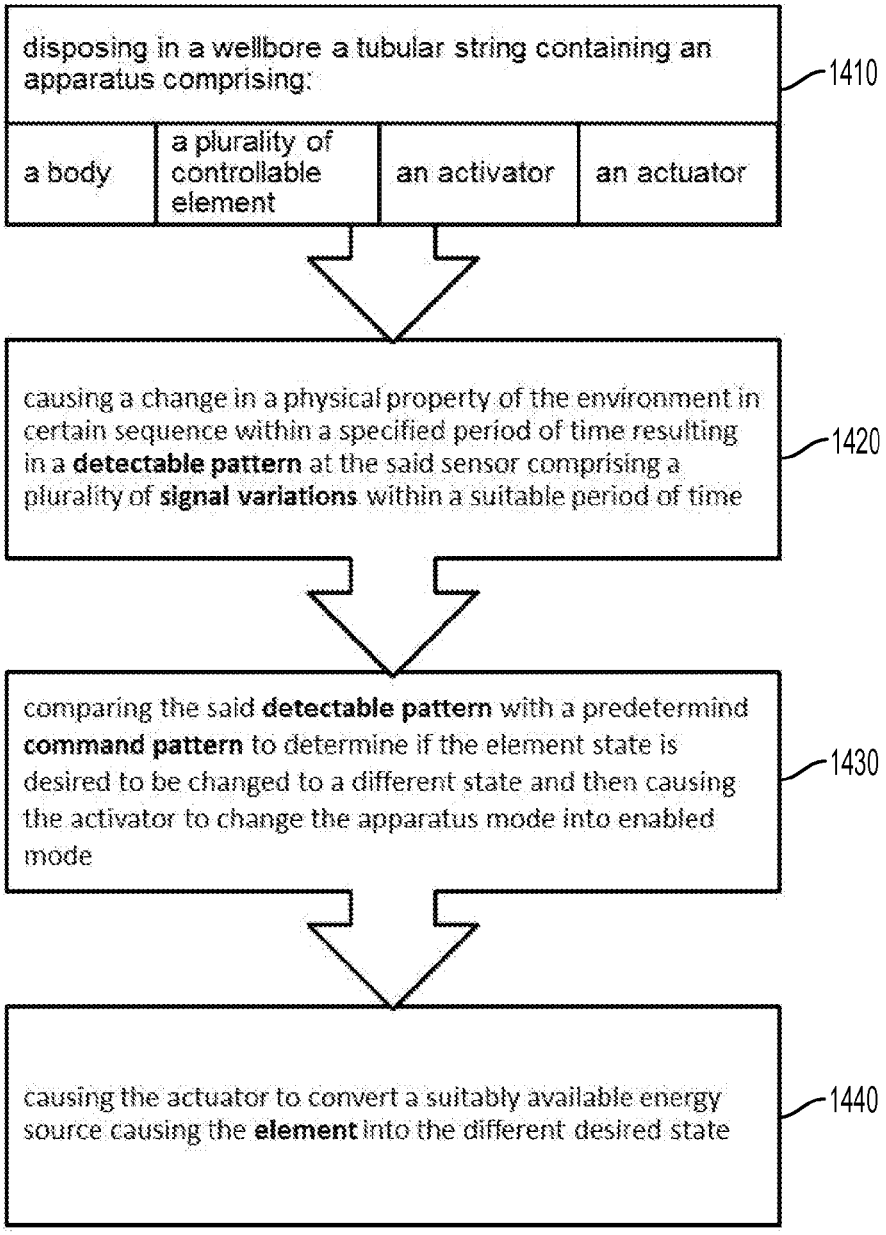
FIG. 14 is a flowchart of the disclosed method describing, in one example, the steps suitable for remotely and selectively controlling an apparatus disposed in a wellbore.

FIG. 14 is a flowchart of the disclosed method describing, in one example, the steps suitable for remotely and selectively controlling an apparatus disposed in a wellbore. In one example, an apparatus is disposed within a wellbore 100 and includes the step 1410 of disposing in a wellbore 100 a tubular string 110 containing a plurality of an apparatus comprising a body 200, a plurality of controllable element, an activator 270 and an actuator 240. The method also includes the step 1420 of causing a change in at least one physical property of the environment in certain sequence within a specified period of time resulting in a detectable pattern of signal variations within the apparatus comprising plurality of signal variations within a suitable period of time. The method also includes the step 1430 of comparing the detectable pattern with a predetermined pattern called a command pattern 899 to determine whether a controllable element state within the apparatus is desired to be changed and then cause the activator 270 to change the apparatus mode into enabled mode. The method also includes the step 1440 of causing the actuator 240 to transform a suitably available energy source to cause the controllable element into the different desired state.

Figure 15:
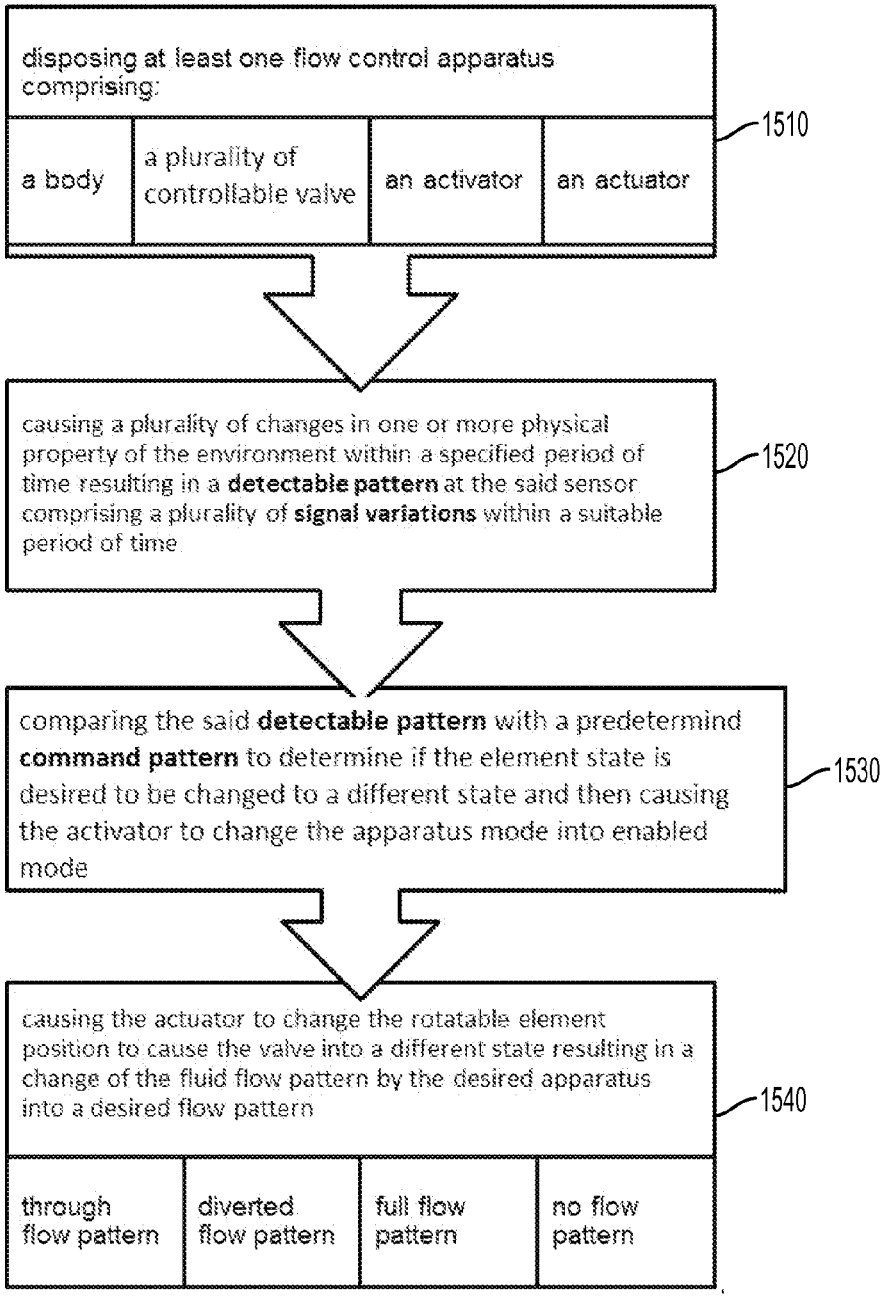
FIG. 15 is a flowchart of the disclosed method describing, in one example, the steps for selectively and remotely controlling a flow passage causing desired flow pattern within a wellbore.

FIG. 15 is a flowchart of the disclosed method describing, in one example, the steps for selectively and remotely controlling a flow passage causing desired flow pattern within a wellbore. In one example, the method for selectively and remotely controlling a flow passage causing desired flow pattern within a wellbore 100 includes the step 1510 of disposing a tubular string 110 containing a plurality of an apparatus comprising a body 200, a plurality of controllable valve 220, an activator 270 and an actuator 240. The method also includes the step 1520 of causing a change in at least one physical property of the environment in certain sequence within a specified period of time resulting in a detectable pattern of signal variations within the apparatus comprising plurality of signal variations within a suitable period of time. The method also includes the step 1530 of comparing the detectable pattern with a predetermine pattern called a command pattern 899 to determine whether a controllable valve 220 state within the apparatus is desired to be changed and then cause the activator 270 to change the apparatus mode into enabled mode. The method also includes the step 1540 of causing the actuator 240 to transform a suitably available energy source to cause the controllable valve 220 into the different state suitable for changing the flow pattern into the desired flow pattern. As a result, the flow pattern will take any of the flowing patterns, no flow, full flow, a diverted flow and a through flow as explained in FIGS. 7, 8, 9, and 10.

Figure 16:
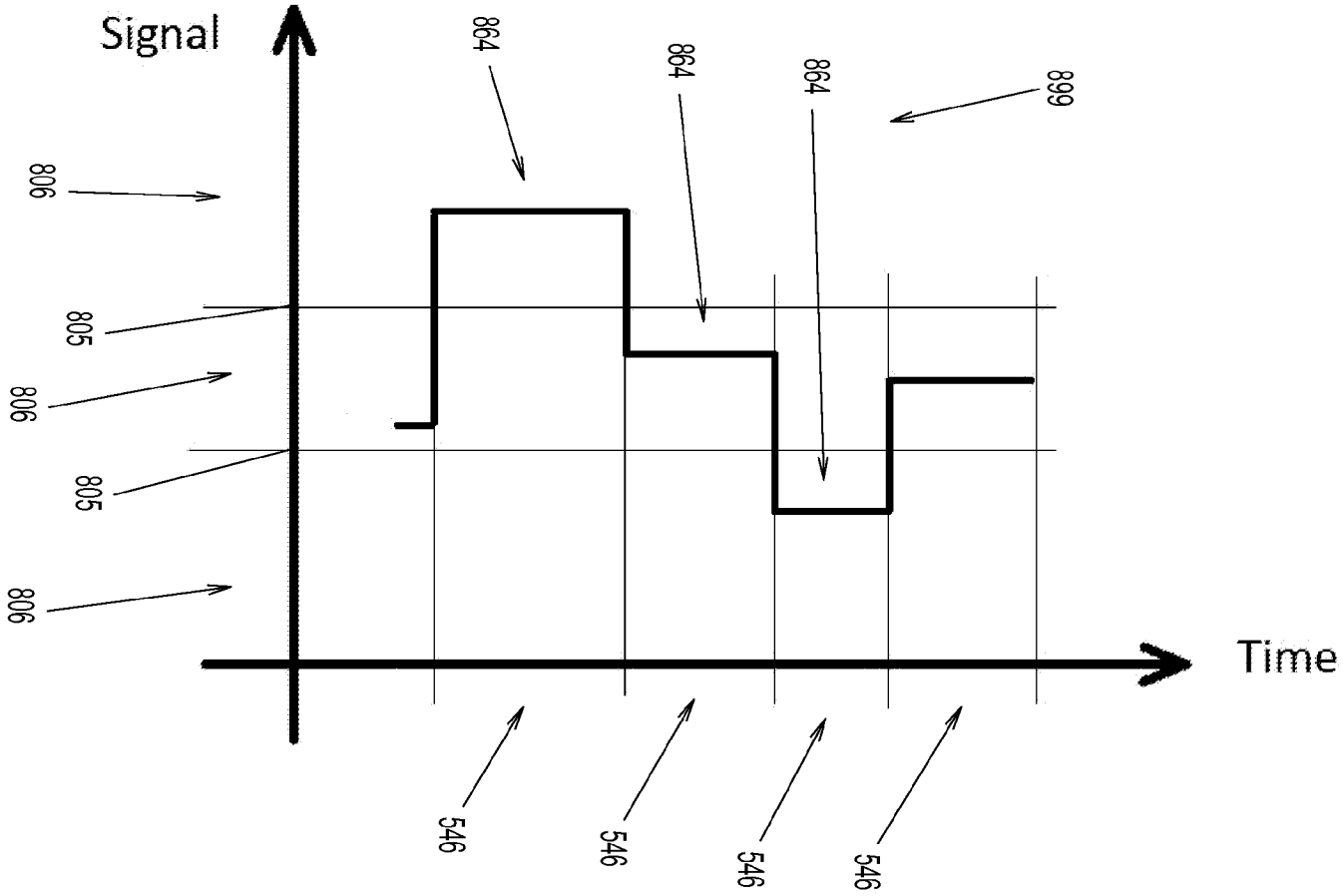
FIG. 16 is a diagram of an example form of signal pattern comprising a sequence of signal variations over a period of time.

FIG. 16 is a diagram of an example form of signal pattern comprising a sequence of signal variations over a period of time. This diagram is also aimed to aid understanding the terms used in the description in this disclosure. In one example, a signal level point 805 is any possible value of a signal. A signal level zone 806 is defined as any signal value within suitable two signal points, defining the signal level zone 806 boundaries. A time period is referenced as the period of time between any two time points. A time zone 546 is defined as the time period when the signal value stays within a signal level zone 806. When a signal value is changed to a different signal level zone 806, a different time zone 546 is defined. A signal is said to have a possible reference pattern 864 if its value stays within a particular signal level zone 806 for a specific time zone 546. In one example, a sequence of reference patterns is, or is used as, or is referred to as, a command pattern.

Figure 17:
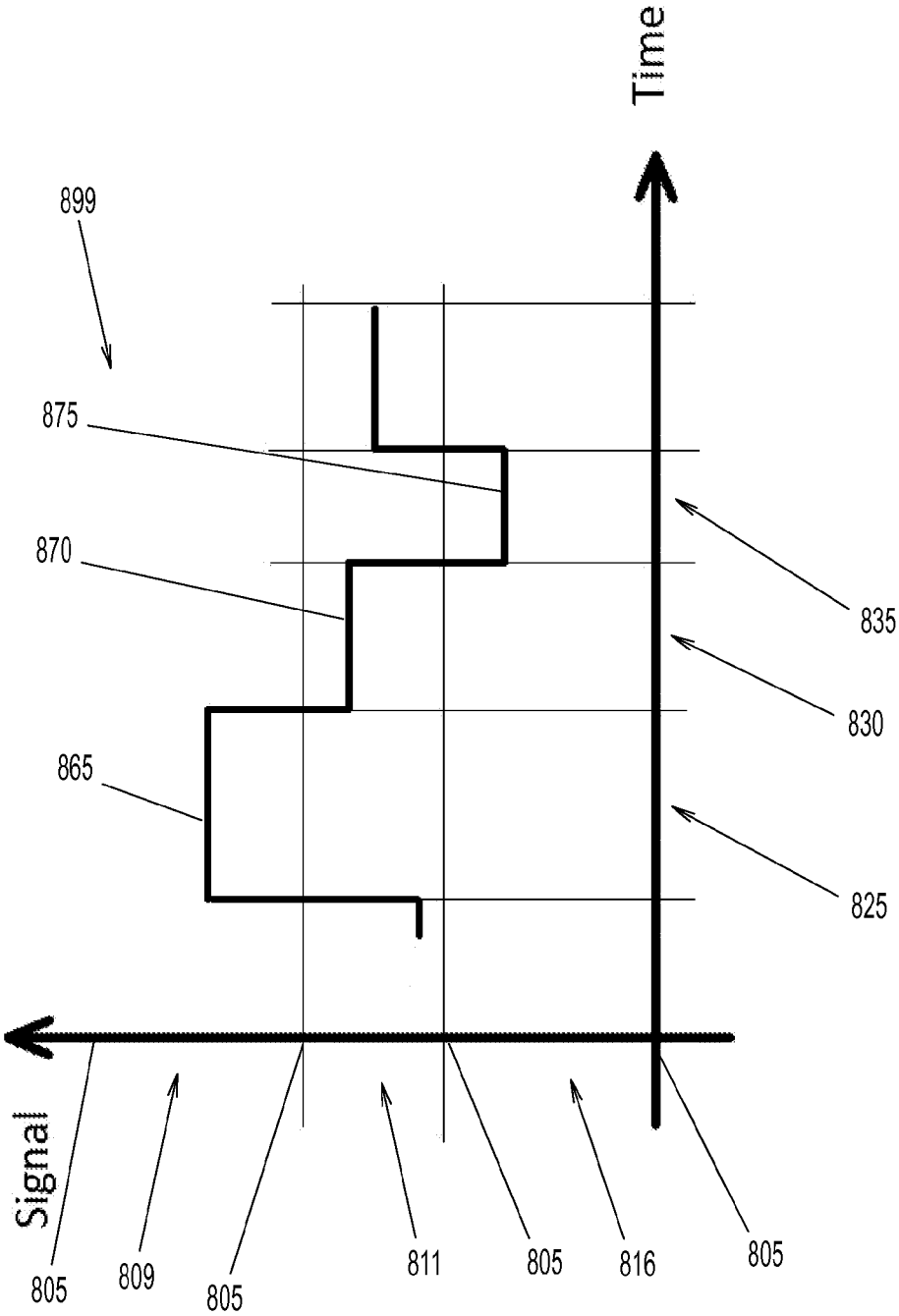
FIG. 17 is a diagram of an example form of reference (or command) pattern comprising a predetermined set of signal variations within a specific period of time.

FIG. 17 is a diagram of an example form of reference pattern 864 comprising a predetermined set of signal variations within a specific period of time. For example, a reference pattern A (865) is defined for the signal value within signal level zone 1 (809) and for a time zone A (825), and a reference pattern B (870) is defined for the signal value within signal level zone 2 (811) and for a time zone B (830). Similarly, a reference pattern C (875) is defined for the signal value within signal level zone 3 (816) and for a time zone C (835).

Figure 18:
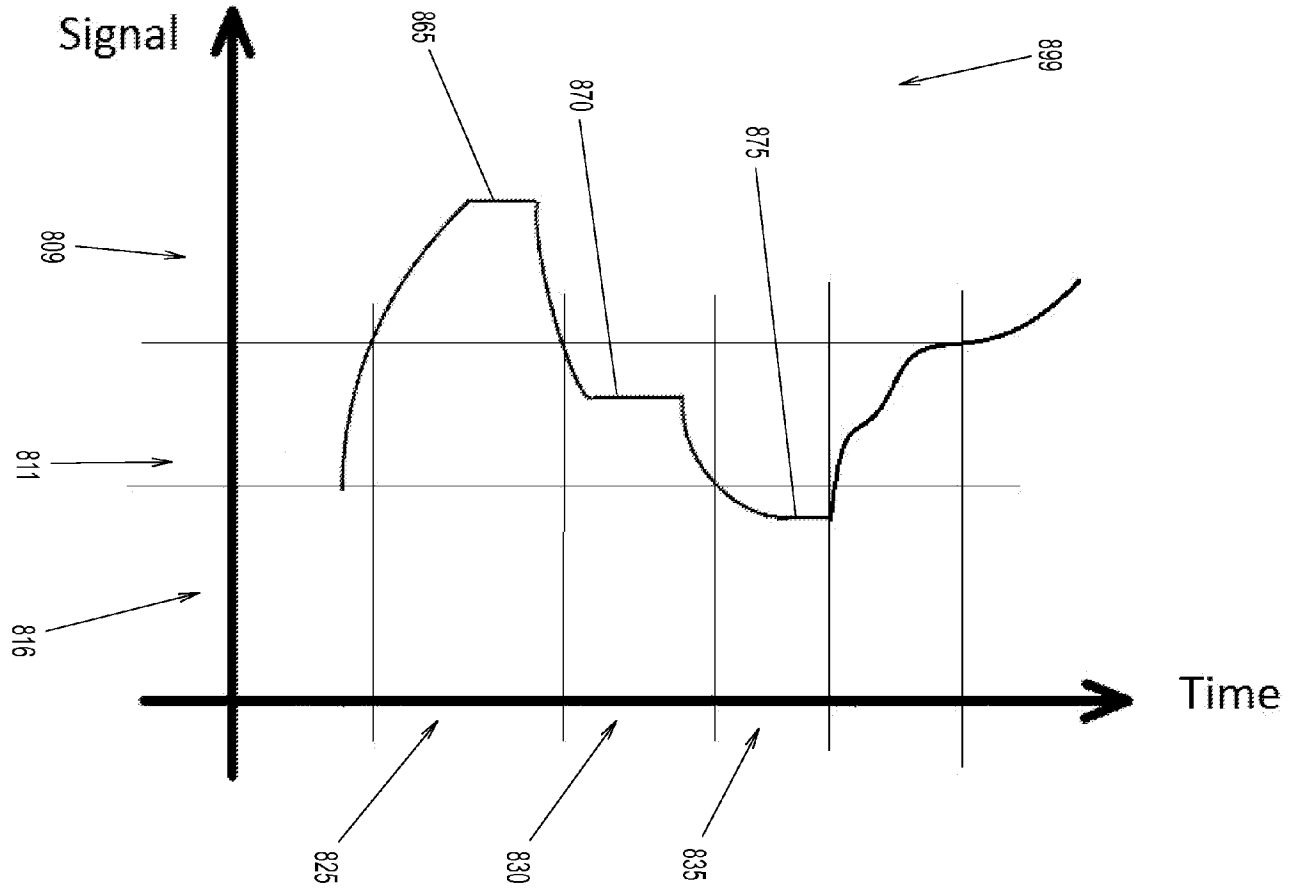
FIG. 18 is a diagram of an example form of signal variations within a suitable period of time acceptable as matching with the reference/command pattern.

FIG. 18 is a diagram of an example form of signal variations within a suitable period of time acceptable as matching with the reference pattern. In this example, the sequence of a reference pattern A (865), a reference pattern B (870), and a reference pattern C (875). A signal is said to have other pattern 880 if it stays within a particular signal level zone 806 for other time zone 840 not matching those defined by reference pattern A (865), or reference pattern B (870) or reference pattern C (875).

Figure 19:
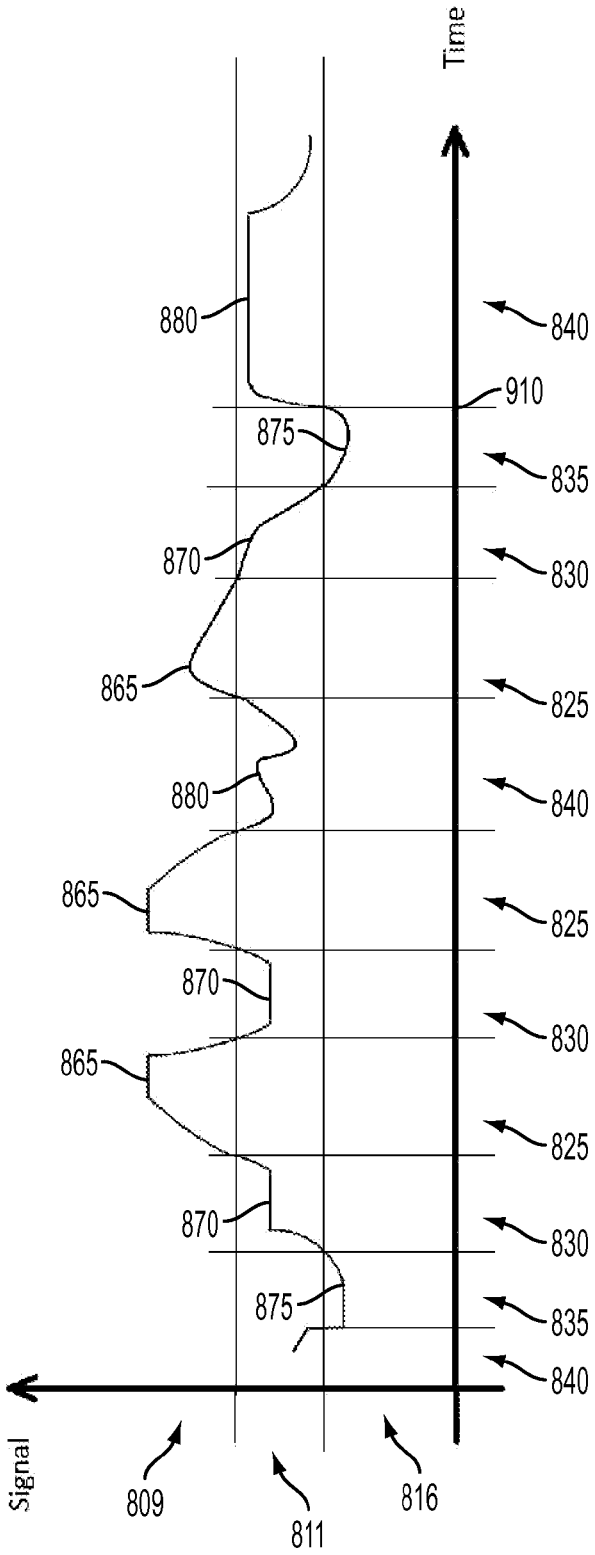
FIG. 19 is a diagram of an example form of detectable pattern of signal variations within a suitable period of time having an example form of matching pattern to the reference/command pattern.

FIG. 19 is a diagram of an example form of detectable pattern of signal variations within a suitable period of time having an example form of matching pattern to the reference/pattern. In chronological order the activator 270 processor will interpret the sensor 272 signal by referring to reference pattern A (865), reference pattern B (870), reference pattern C (875), and other pattern 880 as follows: a reference pattern C (875), then a reference pattern B (870), then a reference pattern A (865), then a reference pattern B (870), then a reference pattern A (865) then other pattern 880 then a reference pattern A (865), then a reference pattern B (870), then a reference pattern C (875), then other pattern 880.

Figure 20A:
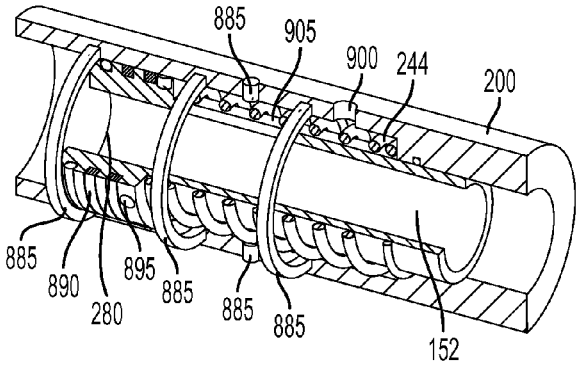
FIGS. 20A, 20B, 20C are detailed perspective cutaway views of an example embodiment of a means for transforming hydraulic energy from fluid in the wellbore into electric energy source suitable for operating the valve, or, in an example, a mechanical movement directly into making a suitable movement of the rotatable element.
Figure 20B:
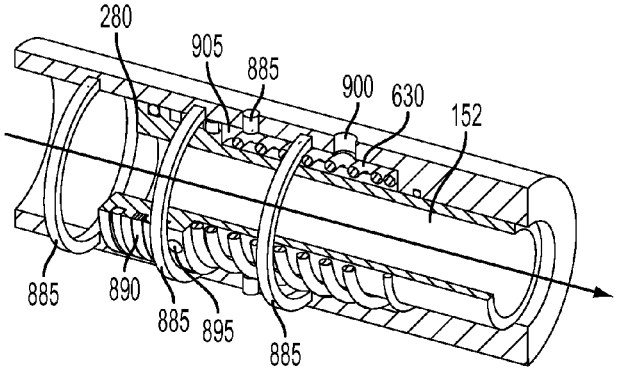
Figure 20C:
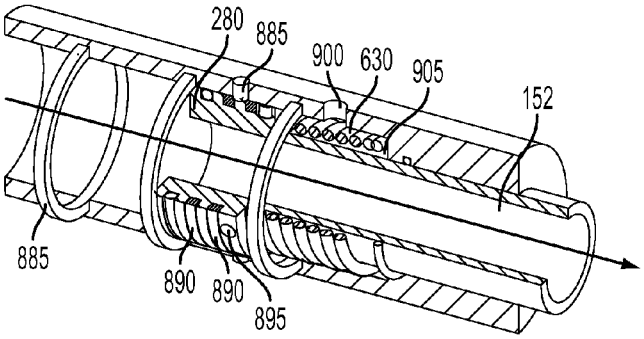

FIGS. 20A, 20B, 20C are detailed perspective cutaway views of an example embodiment of a means for transforming hydraulic energy from fluid in the wellbore into electric energy source suitable for operating the valve, or, in an example, a mechanical movement directly into making a suitable movement of the rotatable element. FIG. 20A is a view of the apparatus during no circulation. FIG. 20B is a view of the apparatus during transition between no circulation and mud circulation. FIG. 20C is a view of the apparatus during mud circulation.

In one example, an actuator 240 includes a means for transforming hydraulic energy from fluid in the wellbore 100 into electric energy source. An actuation mandrel 246 is disposed within the body 200 inner space having a flow orifice 280 and inner surface and outer surface 340. A mud compartment 905 defined as the space between the inner body 200 surface and the actuation mandrel 246 outer surface 340 is having a suitably diameter at one end larger than the diameter on the other end and having at least one generator port 900 suitable for connecting fluid within the mud compartment 905 to fluid in the annular passage. The different inner diameter of the mud compartment 905 is such that when the actuation mandrel 246 moves in certain direction will cause the volume of mud compartment 905 to change. A suitable seal element is disposed within the mandrel and body 200 to restrict hydraulic communication between inner flow passage 152 and mud compartment 905. A suitable form of resilient element is disposed within the mud compartment 905 such as a coil spring 244 wherein the movement of the actuation mandrel 246 in certain direction will cause a change in the strain of the said spring 244 and the move of the actuation mandrel 246 in a different direction will cause another change in the strain of the said sprig. One or more electric coil 885 is disposed within the present invention and one or more magnet is further disposed within the present invention such that movement of the actuation mandrel 246 within the body 200 will cause the relative location between the magnet and the electric coil 885. In this figure, different forms of magnets are presented by way of example such as stud magnet 895 and ring magnet 890. An example of different form of a suitable electric coil 885 is also presented having different shapes as in figure.

FIG. 20A is a view of the apparatus during no circulation. FIG. 20C is a view of the apparatus during mud circulation. FIG. 20B is a view of the apparatus during transition between no circulation and mud circulation by way of referring to wellbore 100 operation, and tubular string 110 disposed within a wellbore 100 comprising a drill bit 120, a bottom hole assembly 130, a plurality of flow control apparatus 150 and drill pipe 140.

Figure 21:
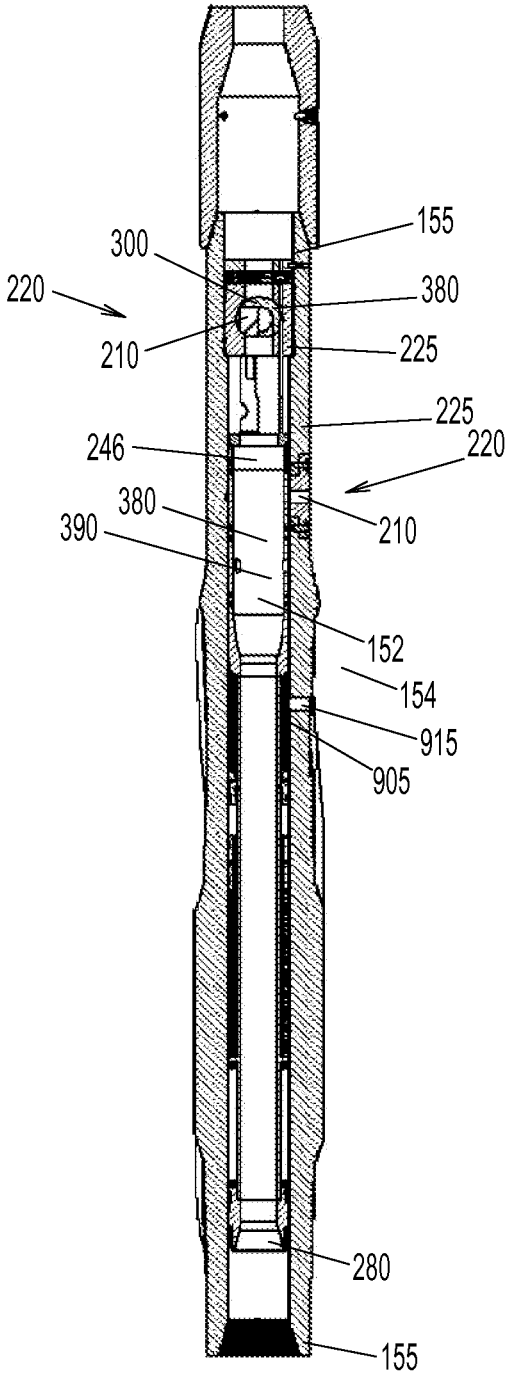
FIG. 21 is a section view of another preferred example of the flow control apparatus 150 comprising plurality of valves.

FIG. 21 is a section view of another preferred example of the flow control apparatus 150 comprising plurality of valves. One valve 220 comprises a moveable element, sliding sleeve 390, comprising a connecting hole. The sliding sleeve 390 is movable within the body 200 by the actuation mandrel movement by the actuator 240, causing the connecting hole to be in position such that it is aligned in communication with the lateral hole 210 and fluid is in communication between the annular flow passage 154 and inner flow passage 152. When the sliding sleeve 390 is moved by the actuation mandrel to another position, communication hole 920 is not in fluid communication with the lateral hole 210 and resulting in the fluid flow between the annular flow passage 154 to be not in communication with the inner flow passage 152 through the communication hole. The body 200 further comprises a pressure compensation hole to connect the annular fluid pressure to an internal compartment of the apparatus for compensating the pressure between the inner mandrel and the pressure of the annular flow passage. The apparatus in FIGS. 21 and 22 comprises another valve 220 such as those described in FIG. 2 in addition to the valve 220 with sliding sleeve 390 element.

Figure 22:
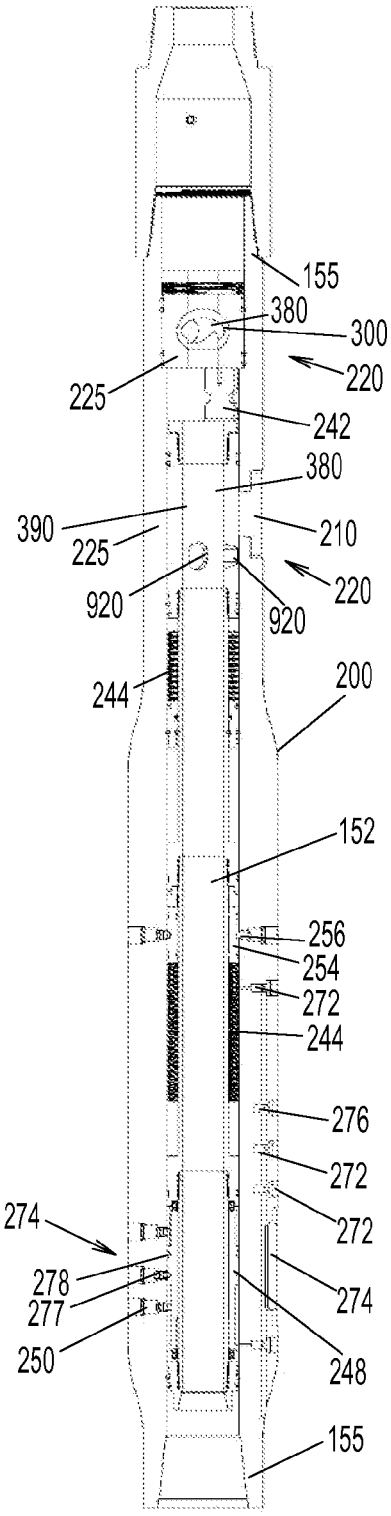
FIG. 22 is another section view of another preferred example of the flow control apparatus 150 comprising plurality of valves.

FIG. 22 is another section view of another preferred example of the flow control apparatus 150 comprising plurality of valves. One valve 220 comprises a sliding sleeve 390 comprising a connecting hole. The sliding sleeve 390 is movable within the body 200 by the actuation mandrel movement by the actuator 240, causing the connecting hole to be in position such that it is aligned in communication with the lateral hole 210 and fluid is in communication between the annular flow passage 154 and inner flow passage 152. When the sliding sleeve 390 is moved by the actuation mandrel to another position, communication hole 920 is not in fluid communication with the lateral hole 210 and resulting in the fluid flow between the annular flow passage 154 to be not in communication with the inner flow passage 152 through the communication hole. Within the body 200 is further disposed a means for interpreting the signal in a form of electronic controller 274. In one example, the electronic controller 274 has a processor, a memory and a suitable wiring to connect the signal from the sensor 272 to the processor, and a suitable wiring to connect the power to an actuator 240 means such as the electric motor 620 or solenoid in order to move the movable element 380 or to unlock the lock 277 disposed within the apparatus. The apparatus further includes a sensor 272 responsive to chemical composition of the fluid within the wellbore 100 or, in one example, within the tubular string. In one example, changes in fluid chemical composition generate a suitable signal and a type of sensors sensitive to fluid chemical composition is used, allowing interpretation or analysis to identify or otherwise decode a command pattern 899.

In one example, the apparatus in FIGS. 21 and 22 includes another valve 220 having a movable element 380 in the form of sliding sleeve 390 element.

Drilling risks encountered during wellbore 100 operations include by way of examples having cutting beds 175, having suspended cuttings 170 in the well bore or having fluid losses into porous formation or fractures 160. It is desirable to change annular flow velocity at certain points within the wellbore 100 to improve hole cleaning by way of causing the cutting beds 175 and suspended cuttings 170 to move up the wellbore 100 annular passage to surface. It is further desirable to dispose certain fluid composition such as materials and chemicals to treat formation damage and reduce fluid losses. It is further desirable to introduce cement composition in a suitable form for treating a wellbore 100 fracture through the wellbore 100 to plug the formation fractures 160 without flowing the cement through the bottom hole assembly 130 components. It is further desirable to control flow pattern within the wellbore 100 and between inner flow passage 152 and annular passage at different points within the tubular string 110 to deal with one or more of the drilling operations risks encountered. During customary drilling operation such as when the drill bit 120 cuts and removes new formation at the bottom of the well and enlarging the wellbore 100, it is further desirable to have continuous mechanical access through the inner flow passage 152 to enable running wireline services such as gyro survey to evaluate the well directional information. It is further desirable to dispose a drop ball activated equipment such as under reamers within the same tubular string 110. It is further desirable to enable the operator to use optimized drilling parameters such as varying flow rate or drilling with high pressure without undesirably causing the flow control apparatus 150 into a different mode. It is further desirable to dispose plurality of flow control apparatus 150 within the same tubular string 110 at various points and operate each one individually and selectively. It is further desirable to operate the flow control apparatus 150 to cause plurality of fluid flow pattern including one or more of the following flow patterns: through flow, lateral flow, full flow or no flow. It is further desirable to dispose the flow control apparatus 150 within the tubular string 110 such that mechanical restrictions within the inner flow passage 152 caused by other components of the tubular string 110 disposed between the flow control apparatus 150 and surface does not restrict the operation of the flow control apparatus 150. It is further desirable to operate the flow control apparatus 150 efficiently independent of the depth or the deviation of the point where the flow control apparatus 150 is disposed with respect to the tubular string 110. The present invention introduces an apparatus and method to address some or all of the above desirables without the need to pull the tubular string 110 out of the wellbore 100 and resulting in a substantial savings of operation time and reduce operating cost.

Therefore, in one example, the apparatus for remotely and selectively control fluid flow in tubular strings and wellbore annulus 156 has:

a. body 200 defining the boundaries between an inner flow passage 152 through the said apparatus and an annular flow passage 154 within the wellbore annulus 156 and having two suitable end connections and at least one lateral hole 210 suitable for connecting the inner flow passage 152 and the annular flow passage 154;

b. a controllable valve 220 operable in plurality of desired states altering the fluid flow pattern within the wellbore 100 wherein the said valve 220 is having at least one rotatable element 300 wherein the said element is rotatable to plurality of desired positions. The valve 220 further divides the inner flow passage 152 into upstream 157 section and downstream 159 section wherein upstream 157 section is defined as the portion of the inner flow passage 152 from the valve 220 and through the upstream 157 end connection 155 of the flow control apparatus 150 and the downstream 159 section as defined as the portion of the inner flow passage 152 from the valve 220 and through the downstream 159 end connection 155 of the body 200;

c. an activator 270 disposed within the body 200 capable of selectively change the apparatus in either one of two modes: a disabled mode wherein the said valve 220 is not operable, and an enabled mode wherein the said valve 220 is operable to a different state, comprising a means for detecting an intended change in the environment; and d. an actuator 240 capable of changing the rotatable element 300 position to cause the valve 220 into a desired state comprising a means for transforming a suitably available energy source into a mechanical movement.

In one example, the rotatable element 300 is suitably selected to cause the valve 220 into a suitable state and to cause a change of the flow pattern into one or more of the following patterns:

i. no flow pattern wherein the flow passage between the upstream 157 section and the downstream 159 section is restricted and the flow passage between the inner flow passage 152 and the annular flow passage 154 is also restricted and the valve 220 is in no flow state;

ii. through flow pattern 705 wherein the passage between the upstream 157 section and the downstream 159 section of the inner flow passage 152 is not restricted whereas the passage between the inner flow passage 152 and the annular flow passages is restricted and the valve 220 is in through flow state;

iii. diverted flow pattern 710 wherein the flow passage between the upstream 157 section and the said annular flow passage 154 is not restricted whereas the flow passage to the downstream 159 section is restricted and the valve 220 is in diverted flow state; and iv. full flow pattern 715 wherein the flow passage between the upstream 157 section and the downstream 159 section of the inner flow passage 152 is not restricted and the flow passage between the said inner flow passage 152 and the annular flow passages is not restricted and the valve 220 is in full flow state.

In one example, rotatable element 300 has a suitable embodiment explained by way of example in FIG. 3.

In one example, the activator 270 further comprises a plurality of suitable sensor 272 means for detecting an intended change in at least one physical property of the environment resulting in a signal within the apparatus suitable for processing. By way of example, in one example of the apparatus, the sensor 272 means is a form of pressure sensor 272 suitable to be affected by pressure variation within the wellbore 100 caused by way of example by a change of depth or change of fluid flow pressure. In another example, the sensor 272 means is a flow sensor 272 suitable to be affected by variation of flow property such as fluid flow rate within the wellbore 100. In another example, the sensor 272 means is a form of an electrode suitable for detecting an electrical signal such as a change of the potential voltage or electric current of the said electrode with respect to the tubular string 110 caused by an induced electric signal into the formation. In another example, the sensor 272 means is a form of an accelerometer affected by change of tubular string 110 movement in one or more direction such as the rotation speed or axial movement speed or any combination thereof. In another example, the sensor 272 means is a form of magnetometer affected by magnetic field changes due to change of surrounding magnetic conductivity of the environment at the apparatus caused by change of the detected signal of earth magnetic field in certain pattern caused induced by a change of the apparatus location in earth by way of moving the tubular string 110. It is understood that the sensor 272 means could take any other form suitable for detecting at least one change of the environment at the apparatus.

In one example, the activator 270 further comprises a controller 274 means disposed within the flow control apparatus 150 in a form suitable for processing the signal generated by the sensor 272 means explained above.

In one example, controller 274 means is capable of comparing the detected signal pattern to a predetermined command pattern 899. When a command pattern 899 is detected, the controller 274 means causes the suitable change within the apparatus to cause the desire change of the apparatus mode then to cause the change of the controller 274 to make the suitable changes within the apparatus to change the controllable valve 220 into the desired state. The controller 274 further comprises a movement limiting means to limit the actuation linkage 242 movement and cause it to stop at a desired displacement. By a way of example, movement limiting means of movement control include a barrel cam 248 disposed within the body 200 and suitably connected to the actuation mandrel 246. The said barrel cam 248 comprises a cam track 740 with a profile suitable for the cam follower 250 disposed within the body 200 to limit the movement of the barrel cam 248 travel between specific predetermined two or more track point such as those explained in FIG. 12 and FIG. 14. Any of the said track point restricts the barrel cam 248 displacement from movement in one or more direction. As the barrel cam 248 is suitably connected with the actuation mandrel 246, when the flow control apparatus 150 is in enabled mode, the movement of the barrel cam 248 as determined by the cam follower 250 traversing the cam track 740 causing the actuation mandrel 246 movement to be restricted to move to a specific position.

In one example, the activator 270 further comprises a locking means suitable for selectively change the apparatus mode when it is desired to change the apparatus mode to an enabled mode or to a disabled mode. By way of example, the locking means comprises a lock 277 element such that when engaged with a suitable locking groove 278 suitably connected with the actuation mandrel 246, restricts the movement of one or more of the actuator 240 elements such as the actuation mandrel 246 and cause the flow control apparatus 150 to be in a disabled mode. When the apparatus is in disabled mode, the valve 220 is not operable to change its state. When the lock 277 is disengaged from the locking groove 278, the actuator 240 disposed within the flow control apparatus 150 will not be restricted by the lock 277 element and the flow control apparatus 150 will be in enabled mode and the valve 220 will be operable into a different state.

In an example as described in FIG. 11, the lock 277 is caused to change position by a suitable lock driver 720. The lock driver 720 in one example is a suitable solenoid. In another example, the lock 277 viewed in FIG. 11 is driven by lock driver 720 in a form of a suitable motor. It is understood that the lock 277 can be driven by other suitable lock driver 720 to cause it to move between at least two positions such that, in one position lock 277 is disengaged from the locking groove 278, and in another position the lock 277 is suitably engaging the locking groove 278. In one example where the lock driver 720 is a solenoid, for example, when a suitable electric charge is connected to the solenoid, the solenoid becomes energized causing the lock 277 to retract into the body 200 and the lock 277 is caused to disengage away from the locking groove 278 causing the flow control apparatus 150 into enabled mode.

In one example, the solenoid is further operable such that when energized with a different suitable charge the lock 277 is caused to extend through the inner wall of the body 200 and is caused to be suitably engaged with the locking groove 278 causing the flow control apparatus 150 into a disabled mode. The same function made by the solenoid means of lock driver 720 is be achieved by a suitable motor in another example. It is understood that the locking means by way of example and does not limit the apparatus locking to these mentioned examples. When the lock 277 is engaged with the suitable locking groove 278 disposed within the actuation mandrel 246, it restricts the movement of the actuation mandrel 246 therefore restricting the movement of the actuation linkage 242 and therefore the movement of the rotatable element 300 is restricted and the valve 220 is restricted from changing its state and not operable into a different state. The flow control apparatus 150 is said to be in disabled mode when the valve 220 is not operable to a different state. When the lock 277 is disengaged from the locking groove 278, the actuator 240 mandrel disposed within the flow control apparatus 150 will not be restricted by the lock 277 element and the flow control apparatus 150 will be in enabled mode and the valve 220 will be operable into a different state. The flow control apparatus 150 is said to be in enabled mode when the valve 220 is operable to a different state. The locking means explained is by way of example. Another example of the locking means is explained; in a different example of the actuator 240 such as the example in FIG. 6 where the actuator 240 comprises a suitable electric motor 620, the locking means is achieved by disconnecting the electric energy source form the electric motor 620 causing the electric motor 620 to be inoperable and accordingly the rotatable element 300 to be restricted from changing position by means of the gear arrangement where the worm engaged with the pinion 420 act as a break when the worm gear 610 is not rotatable, and the flow control apparatus 150 is then said to be in the disabled mode. When the electric motor 620 is connected to the suitable electric energy source, it rotates in a suitable direction causing the worm gear 610 to rotate causing the pinion 420 to rotate in a suitable direction and resulting in a change of the rotatable element 300 position and the valve 220 is operable into a different state and the flow control apparatus 150 is said to be in enabled mode during when the electric energy source is connected to the said motor.

In one example, flow control apparatus 150 further comprises an actuator 240 capable of changing the rotatable element 300 position to cause the valve 220 into a desired state therefore causing a change in flow pattern comprising a means for transforming a suitably available energy source into a mechanical movement. In one example, the actuator 240 comprises a form of an electric motor 620 powered by a suitable battery 276 or a suitable generator or capacitor or other suitable electric energy source disposed within the apparatus or available on a different location within the tubular string 110 or on surface and connected to the apparatus by connecting means such as wireline cable introduced form surface to the apparatus through wellbore 100. In this example of actuator 240 having an electric motor 620 means of transforming a suitably available electrical energy source into a mechanical energy is capable of changing the position of the rotatable element 300 by means of linkage in the form of a suitable gear engagement such as worm gear 610 and pinion 420. When the said electric energy source is connected to the electric motor 620 causing the worm gear 610 connected to the electric motor 620 output to adequately rotate the pinion 420 that is suitably connected to the rotatable element 300 around the pivot 307 and will cause a change of the rotatable element 300 position and accordingly a change of the controllable valve 220 state and a suitable change of the flow pattern.

In another example, the actuator 240 transforms an energy source in the form of an energized resilient element such as a spring 244. The resilient element stores energy when caused to change its state from relaxed state to a strained state alternatively called an energized state by means of causing a strain to the resilient element such as by means of coiling, compressing or stretching the resilient element from a less strained state. The said resilient element in such a strained state when suitably connected to the rotatable element 300 and when the apparatus is in enabled mode will cause the rotatable element 300 into a different position. In another example, the form of resilient element energy source is pre-energized before disposing the flow control apparatus 150 into the wellbore 100. In a further other example, the resilient element energy source is energized while within the wellbore 100 by another energy source such as hydraulic flow as explained in the embodiment viewed in FIG. 20.

In an example, the actuator 240 comprises a means suitable to transform a form of mechanical energy source caused by an inertia mass element disposed within the flow control apparatus 150 into a mechanical movement suitable for changing the rotatable element 300 position. When the flow control apparatus 150 is in enabled mode, and when the inertia element 510 is suitably energized by way of momentum or inertia for example through movement of tubular string 110, the inertia element 510, suitably connected to the rotatable element 300 as explained earlier, will cause a change of the rotatable element 300 position and accordingly cause a change in the valve 220 state.

In an example, the actuator 240 is suitable for transforming a hydraulic energy of the fluid flowing through the inner flow passage 152 or annular flow passage 154 or any combination thereof to generate a suitable mechanical energy causing the rotatable element 300 to change position explained herein. The practice of introducing drilling fluid composition into the tubular string 110 inner flow passage 152 will cause the fluid in the inner flow passage 152 to have higher pressure than the fluid in the annular flow passage 154 at the same depth, and the fluid is called to be circulated through the inner flow passage 152 and the operation is commonly called mud circulation. When no fluid is introduced into the tubular string 110 inner flow passage 152, the fluid pressure in the inner flow passage 152 will be similar to the fluid pressure in the annular flow passage 154 at the same depth and the operation is commonly called no circulation.

In an example, the apparatus actuator 240 described in FIG. 20 harvests energy from the change of pressure between the inner flow passage 152 and the annular flow passage 154 at the apparatus depth during the mud circulation and stores it through deforming a resilient element such as the spring 244 shown in figure. The mud compartment 905 defined as the space between the inner body 200 surface and the actuating mandrel outer surface 340 is having a suitably varying diameter so that fluid pressure exerted on the flow orifice 280 during mud circulation that is higher than the fluid pressure in the mud compartment 905 causing the actuation mandrel 246 to move in the direction suitable to compress the spring 244. During no circulation the pressure in the mud compartment 905 is the same as the pressure in the inner flow passage 152 and the force exerted by the compressed spring 244 will be released causing the actuation mandrel 246 to move to the opposite direction. The actuator 240 is further having an arrangement of electric coils and magnets such as stud magnet 895 or ring magnet 890 or any combination thereof. When the actuation mandrel 246 moves with the effect of mud circulation in one direction and moves again at no circulation in the opposite direction it will cause a change of magnetic field detected by the electric coil 885 caused by the change of relative position of the electric coil 885 and the magnet element causing electric charges observed in the electric coil 885. In a further example of the present invention, the said electric charges is utilized to move the electric motor 620 and in a further example, the said electric charges is utilized to charge a suitable means of storing electric charge such as capacitor or rechargeable battery 276. A method of energy harvesting is now explained where electric energy is harvested from hydraulic energy within the wellbore 100, and a mechanical energy is harvested from hydraulic energy within the wellbore 100. It is understood that the energy sources explained herein are made by way of example and not exhaustive. The same function is possible to be achieved by other means of energy sources suitably available within the apparatus.

In one example, the actuator 240 comprises an actuation mandrel 246 having a suitable flow orifice 280 profile that is affected by fluid flowing through the inner flow passage 152. When fluid flows through the actuation mandrel 246 the hydraulic energy from the said fluid flow exerts a suitable force on the flow orifice 280 causing the actuation mandrel 246 to move with respect to the body 200 and exerting a suitable force on the actuation linkage 242 suitably attached to the rotatable element 300 push-pull point 308 causing the rotatable element 300 to move and causing the rotatable element 300 to change its position.

In one example, the flow control apparatus 150 explained herein is normally disposed in the wellbore 100 while in initial valve 220 state of through flow state. Customary drilling operation may take place by including the steps of drilling, flowing drilling fluid into the tubular inner flow passage 152, lowering the tubular string 110 deeper into the earth and extending deeper into the earth by way of removing layer of earth through drilling process by means of drill bit 120 operation. With reference to the preferred example explained in FIG. 2, when the valve 220 state is through flow state as in detail A of FIG. 10, there is no restriction within the inner flow passage 152. When desired, it is possible in this state to run a suitable wireline services such as gyro survey through the tool inner flow passage 152. It is further possible to operate a drop ball operated device disposed within the tubular string 110 by means of introducing a suitable drop ball through the tubular string 110 inner flow passage 152 including the inner flow passage 152 portion through the flow control apparatus 150. When it is desired to change the flow pattern of a particular flow control apparatus 150 disposed within the tubular string 110, a suitable change in the environment is made causing a signal pattern to be detected within the apparatus. A command pattern 899 is suitably formed sequence of signal pattern predetermined and stored within each tool and for each desired command. By way of example, a possible command pattern 899 to change a particular valve 220 disposed within a particular flow control apparatus 150 from one flow state to another flow state comprises the following sequence in order, reference pattern A 865 followed by reference pattern B 870 then followed by reference pattern C 875. A controller 274 disposed within the flow control apparatus 150 processing the signal detected within the apparatus will observe the said command pattern 899 at command time point 910. At command time point 910, the activator 270 will cause the desired change within the apparatus to cause it into the desired mode. The activator 270 further will cause the actuator 240 to cause the controllable valve 220 into the desired state by changing the rotatable element 300 into the desired position by means of transforming a suitably available energy source as explained earlier into a mechanical movement. It is to note that a suitable command pattern 899 is predetermined for each flow control apparatus 150 disposed within the tubular string 110. This is another desired advantage of the present invention allowing a user to dispose a plurality of flow control apparatus 150 within the same tubular string 110 and cause each one individually and selectively into a possible independent valve 220 state and accordingly a suitable flow pattern. It is further to note that the command pattern 899 is suitably predetermined such that change of the environment caused during customary operations will not cause the flow control apparatus 150 to change its mode or flow pattern to change, this is another desirable advantage of the present invention such that optimal operating parameters is possible to be deployed without the risk of undesirably causing the flow control apparatus 150 to change its mode or flow pattern.

In further example, it is possible to extend and apply the same method of selectively controlling a flow control apparatus 150 using command pattern 899 to any other apparatus disposed within a tubular string 110 suitably equipped to detect such a command pattern 899 and cause the desired actuation to selectively take place. The example explained in FIG. 19 and detailed above for the flow control apparatus 150 may be implemented on any other suitably equipped apparatus having a device means suitable for any desired action such as a valve 220. The command pattern 899 explained and disclosed herein is another desirable advantage of the present invention as it provide extra flexibility of disposing plurality of apparatus each could have a different device means to perform a different function. Such a command pattern 899 provides an advantage means to enable the operator to selectively and remotely operate plurality of apparatus disposed within a wellbore 100 into a desired mode or a desired state independently.

Furthermore, and with reference to the flow control apparatus 150, when it is desirable to dispose a particular fluid composition to treat formation damage such as cement composition to treat formation fractures 160, it would be desirable to operate a flow control apparatus 150 dispose within the tubular string 110 between the bottom hole assembly 130 and surface and cause its valve 220 into bypass state. When in bypass state such as the state explained in FIG. 10 detail (B1), (B2) and (B3). It is to note that fluid composition will all exit the lateral hole 210 into the annular passage to reach the damage formation. It is to note that the inner flow passage 152 downstream 159 section of the valve 220 is obstructed in such a way that safeguard bottom hole assembly 130 components disposed between the drill bit 120 and the said flow control apparatus 150 from having such a cement composition undesirably flowing into the said bottom hole assembly 130 components. It is a further advantage that the preferred example explained in FIG. 2 utilizing the valve 220 detailed in FIG. 10 will allow the user to displace all treatment composition fluid within the inner flow passage 152 with another composition fluid without leaving any tangible volume of the treatment composition fluid within the inner flow passage 152. This is another advantage of the present invention whereas when it is desired to change the valve 220 state into through flow state after performing the said disposition of treatment composition fluid into the annular passage, there will be no significant treatment composition fluid within the inner flow passage 152 that would enter the bottom hole assembly 130 inner flow passage 152 and will not be a source of risk to the bottom hole assembly 130 components.

In one example, as the flow control apparatus 150 is rigidly attached to the tubular string 110 through the end connection 155 and the inner flow passage 152 is hydraulically connected to surface and the drilling fluid commonly used in drilling operations is relatively incompressible, causing any change on the surface by means of moving the tubular string 110 in any direction or causing the fluid flow to change in any particular pattern will cause a suitable change in the environment reasonably detectable by sensor 272 disposed within the flow control apparatus 150 nearly at the same time. This is another advantage of the present invention will save significant operating time when compared to a drop ball activated devices where the drop ball has to consume a significant time traversing the inner flow passage 152 from surface to reach its corresponding apparatus. It is a further advantage of the present invention to be operated by causing a command pattern 899 within a similar time independent of the depth or location of the flow control apparatus 150, and independent of the well deviation anywhere in the wellbore 100 where the present invention is disposed of, particularly when compared to drop ball activated apparatus where the drop ball will take different time to reach the corresponding apparatus depending on that apparatus depth, and well deviation. It is a further advantage that the present invention command pattern 899 does not demand a physical access within the inner flow passage 152 allowing the operator to dispose the flow control apparatus 150 within the tubular string 110 below other devices that may have mechanical restriction within the inner flow passage 152 such a drop ball activated apparatus disposed between the flow control apparatus 150 and surface within the same tubular string 110. It is another further advantage that the present invention is operable in unlimited number of times and does not suffer from the limited number of operable cycles that is associated with drop ball activated apparatus imposed by what is called a ball capture means used commonly with apparatus using drop ball system. It is another further advantage that the present invention is operable in one or more of the following flow states: through flow, diverted flow, full flow, and no flow explained earlier providing a far more flexibility to the operator. The through flow is commonly used in customary drilling operation. The diverted flow is of an advantage for composition fluid particularly when the said composition is not suitable to pass through equipment disposed downstream 159 of the flow control apparatus 150, as by the way of example the disposition of cement composition to treat fractures 160 when equipment downstream 159 of the flow control apparatus 150 is a bottom hole assembly 130 component. The full flow pattern 715 is a useful pattern to suitably control or increase the annular fluid velocity aiding to improve hole cleaning and reduce cutting beds 175 and reduce suspended cuttings 170 within the wellbore annulus 156 while at the same time allow for portion of the circulated fluid to flow through the inner flow passage 152 and possibly through the bit perforations 125 to maintain well control at all times. The no flow mode is another important mode suitable for securing the well as a form of sub surface safety valve 220 and could be used in emergency cases where it is desired not to allow flow within the bottom of the well and the inner flow passage 152 such as situations when well control is compromised for example during what is call well kick or early warning of blow out.

While this invention has been described with respect to a limited number of embodiments, those skilled in the art, having benefit of this disclosure, will appreciate that other embodiments can be devised which do not depart from the scope of the invention disclose.

While the invention has been illustrated and described in detail in the drawings and foregoing description, such illustration and description are to be considered illustrative or exemplary and not restrictive and it is not intended to limit the invention to the disclosed embodiments. The mere fact that certain measures are recited in mutually different dependent claims does not indicate that a combination of these measures cannot be used advantageously.

The invention claimed is:

1. An apparatus for remotely controlling fluid flow in a wellbore based on changing the environment in the wellbore, the apparatus disposed on a tubular string in the wellbore, the apparatus comprising:

a body, an inner passage through the body, an orifice to the inner passage disposed on a lateral side of the body, a valve having a movable element, the valve disposed in fluid communication with the inner passage and the orifice, a means for actuating the valve element, a means for powering the means for actuating the valve element, a means for disabling movement of the valve element, a means for detecting at least one change in the environment in the wellbore, a means for decoding the at least one change in the environment, and wherein the means for disabling movement of the valve element is responsive to the means for decoding, and wherein the means for actuating the valve element is responsive to the means for decoding, and wherein the at least one change in the environment includes a mechanical movement of the apparatus by means of moving the tubular string, causing the apparatus to move within the wellbore in at least one direction.

2. The apparatus of claim 1 wherein the moveable element is movable to a plurality of predetermined positions.

3. The apparatus of claim 2 wherein the plurality of predetermined positions comprise at least two predetermined positions selected from the set of predetermined positions including:

restricted fluid flow through the inner flow passage and restricted flow between the inner flow passage and a wellbore annulus through the orifice;

fluid flow communication through the inner flow passage and restricted fluid flow between the inner flow passage and a annular flow passage through the orifice;

fluid flow communication between a first end of the body and an annular flow passage and restricted flow between a second end of the body and the annular flow passage; and fluid flow communication between the first end of the body and an annular flow passage and fluid flow communication between the second end of the body and the annular flow passage.

4. The apparatus of claim 2 wherein the movable element comprises at least one surface of spherical shape and at least two ports and one cavity.

5. The apparatus of claim 1 wherein the detecting means comprises a sensor.

6. The apparatus of claim 5 wherein the sensor is positioned and arranged in the wellbore environment and configured to sense at least one physical property of the environment.

7. The apparatus of claim 1 wherein the apparatus comprises: at least one means for detecting a plurality of intended changes in at least one physical property of the environment resulting in a detectable signal within the apparatus for processing the signal.

8. The apparatus of claim 1 wherein the means for powering comprises an electric generator.

9. The apparatus of claim 8 wherein the electric generator is an electric generator positioned and arranged to receive hydraulic energy from fluid in the tubular string and is configured to provide electrical energy to the means for actuating.

10. The apparatus of claim 8 wherein the electric generator is an electric generator positioned and arranged to receive hydraulic energy from a fluid pressure difference between the inner fluid passage and the annular fluid passage.

11. The apparatus of claim 1 wherein the means for powering comprises a means for transforming hydraulic energy from fluid in the wellbore.

12. The apparatus of claim 1 wherein the means for powering comprises an energized resilient element.

13. The apparatus of claim 1 wherein the means for actuating comprises an electric motor.

14. A method of remotely and selectively controlling an apparatus disposed in a string within a wellbore, the method including:

disposing in a wellbore a string including an apparatus, the apparatus comprising:

a body;

at least one controllable element operable in plurality of desired states;

a sensor disposed within the body capable of detecting an intended change in a physical property of an environment; and an actuator suitable for changing the at least one controllable element into a desired state;

causing a change in a physical property of the environment in certain sequence within a specified period of time resulting in a detectable pattern at the sensor, the change in a physical property comprising a sequence of a plurality of signal variations within a suitable period of time;

comparing the said detectable pattern with a command pattern to determine if the controllable element state is desired to be changed to a different desired state;

causing the actuator to convert a suitably available energy source, causing the at least one controllable element into the different desired state; and wherein the change in a physical property of the environment comprises a mechanical movement of the apparatus by means of moving the string, causing the apparatus to move within the wellbore in at least one direction detectable by the said sensor.

15. The method of claim 14 wherein the change in a physical property of the environment comprises a change of property of fluid introduced from surface into the wellbore detectable by the sensor.

16. The method of claim 14 wherein the change of physical property includes a change in one or more of the following fluid properties: pressure, temperature, flow rate, density, viscosity, color, and composition, detectable by the sensor.

17. The method of claim 14 wherein the change in a physical property of the environment is a change of electromagnetic field detectable by the said sensor.

18. The method of claim 14 wherein the change in a physical property of the environment is a change of electric field detectable by the said sensor.

19. The method of claim 14 wherein the at least one controllable element is a valve.

20. A method for remotely and selectively controlling fluid flow in a tubular string and wellbore annulus, the method comprising:

disposing a tubular string into a wellbore comprising at least one flow control apparatus, the apparatus comprising:

a body defining boundaries between an inner flow passage through the said apparatus and an annular flow passage within the wellbore annulus and having two suitable end connections and at least one lateral hole suitable for connecting the inner flow passage and the annular flow passage;

a controllable valve operable in a plurality of desired states altering the fluid flow pattern within the wellbore, wherein the valve includes at least one movable element having plurality of surfaces, wherein the movable element is movable to a plurality of desired positions, wherein the valve further divides the inner flow passage into an upstream section and a downstream section, wherein the upstream section is the portion of the inner flow passage from the valve and through one end connection of the body and the downstream section is the portion of the inner flow passage from the valve and through the other end connection of the body;

a sensor means disposed within the body responsive to an intended change in the environment; and an actuator capable of changing the position of the movable element to cause the valve into a desired state, comprising a means for transforming a suitably available energy source into a mechanical movement;

causing a plurality of changes in one or more physical property of the environment within a specified period of time resulting in a detectable pattern at the sensor comprising a plurality of signal variations within a suitable period of time;

comparing the detectable pattern with a command pattern to determine if the valve state is desired to be changed to a different desired state and then causing the activator to cause the apparatus mode into the desired mode; and causing the actuator to change the movable element position to cause the valve into a different state resulting in a change of the fluid flow pattern by the desired apparatus into a desired flow pattern, and wherein at least one change in the one or more physical property of the environment comprises a mechanical movement of the apparatus by means of moving the tubular string, causing the apparatus to move within the wellbore in at least one direction detectable by the said sensor.

* * * * *